US006961040B2

(12) United States Patent
Ohashi et al.

(10) Patent No.: US 6,961,040 B2
(45) Date of Patent: Nov. 1, 2005

(54) TWO-DIMENSIONAL MONOCHROME BIT FACE DISPLAY

(75) Inventors: Mitsuo Ohashi, Tokyo (JP); Fumio Kawaguchi, Tokyo (JP); Katsue Ueda, Osaka (JP); Motohiro Kurisu, Kanagawa (JP)

(73) Assignee: Eizo Nanao Corporation, Ishikawa (JP)

( * ) Notice: Subject to any disclaimer, the term of this patent is extended or adjusted under 35 U.S.C. 154(b) by 455 days.

(21) Appl. No.: 10/126,318

(22) Filed: Apr. 19, 2002

(65) Prior Publication Data

US 2003/0071775 A1 Apr. 17, 2003

(30) Foreign Application Priority Data

Apr. 19, 2001 (JP) ..... 2001-121318
Sep. 10, 2001 (JP) ..... 2001-273194

(51) Int. Cl.[7] ..... G09G 3/28
(52) U.S. Cl. ..... 345/88; 345/694; 345/89
(58) Field of Search ..... 345/88–89, 600, 345/690–697, 94, 97

(56) References Cited

U.S. PATENT DOCUMENTS

| | | | | |
|---|---|---|---|---|
| 6,016,133 | A | 1/2000 | Nito et al. | |
| 6,414,664 | B1 * | 7/2002 | Conover et al. | 345/89 |
| 6,417,868 | B1 * | 7/2002 | Bock et al. | 345/698 |
| 6,700,559 | B1 * | 3/2004 | Tanaka et al. | 345/88 |

FOREIGN PATENT DOCUMENTS

| | | |
|---|---|---|
| DE | 19912389 | 10/2000 |
| EP | 0375269 | 6/1990 |
| EP | 0848369 | 6/1998 |
| EP | 0880125 | 11/1998 |
| JP | 61-262724 | 11/1986 |
| JP | 63-108394 | 5/1988 |
| JP | 01-193716 | 8/1989 |
| JP | 02 166419 | 6/1990 |
| JP | 04-240612 | 8/1992 |
| JP | 04-276715 | 10/1992 |
| JP | 07-005432 | 1/1995 |
| JP | 08-234178 | 9/1996 |
| JP | 10-068931 | 3/1998 |
| JP | 11-002800 | 1/1999 |
| JP | 1195693 | 9/1999 |
| JP | 11-311971 | 11/1999 |
| WO | WO 0021067 | 4/2000 |

* cited by examiner

*Primary Examiner*—Amr A. Awad
(74) *Attorney, Agent, or Firm*—David N. Lathrop, Esq.; Gallagher & Lathrop

(57) ABSTRACT

A two-dimensional monochrome bit face display has a luminance resolution that is equal to or higher than that of a CRT monitor. In one implementation, a two-dimensional monochrome bit face display has a bit face in which each pixel is constituted by m sub-pixels and neutral density filters mounted on the m sub-pixels of a respective pixel have light transmittances proportional to values $1/2^n$ where n is an integer. In another implementation, mask filters are mounted on the m sub-pixels and have windows with light transmittances that are proportional to values $1/2^n$. Alternatively, areas of the m sub-pixels are set in the same proportion. The luminance of each sub-pixel is electronically controlled to improve the luminance resolution of the bit face display.

34 Claims, 15 Drawing Sheets

TWO-DIMENSIONAL MONOCHROME BIT FACE DISPLAY

BACKGROUND OF THE INVENTION

1. Field of the Invention

The present invention relates to a two-dimensional monochrome bit face display that displays a monochrome picture or image on its bit face by pixels constituting the bit face and controlled in their luminance or brightness by digital signals each having predetermined bits, and more particularly, to such two-dimensional monochrome bit face display having its luminance resolution equal to or higher than that of a monochrome picture display using a cathode ray tube (CRT).

2. Description of the Related Art

A two-dimensional monochrome bit face display that displays a monochrome picture or image on its bit face by pixels constituting the bit face and controlled in their luminance or brightness by digital signals each having predetermined bits has advantages that it is of small size, of light weight, has low power consumption, etc. However, the luminance resolution or intensity resolution thereof is low as compared with that of a monochrome picture display using a CRT (hereinafter referred to as CRT monitor). For such reason, it is required to improve the luminance resolution of the two-dimensional monochrome bit face display, and various methods for improving the luminance resolution thereof have been heretofore proposed. For example, in case of a liquid crystal display (LCD) that is a typical example of the two-dimensional monochrome bit face display, the following two methods have been well known in the past as methods for making the luminance resolution thereof high:

(1) space modulation dither method and (2) time modulation (frame rate control) method.

The aforesaid space modulation dither method is such that each of many pixels constituting the liquid crystal display face is composed of a plurality of sub-pixels and each sub-pixel is controlled in its luminance thereby improving the luminance resolution of the liquid crystal display. As one specific example of such method, there has been known a procedure in which color filters for R, G and B mounted respectively on three sub-pixels constituting each of the pixels of a color liquid crystal display are removed and the luminance value of each of the sub-pixels is controlled. If the color liquid crystal display is modified such that these three sub-pixels constitute one pixel of a monochrome picture or image, then the luminance resolution of the liquid crystal display operating as a two-dimensional monochrome bit face display can be made high.

This method enables the luminance resolution of the liquid crystal display to make high theoretically up to 768 stages of gradation (in reality, up to 766 stages of gradation since three of the luminance value 0 are unified to one) if the luminance of each of the sub-pixels is electronically controlled over 256 stages of gradation extending from 0 to 255 stages, because one pixel is composed of three sub-pixels. The summed luminance value of each of the pixels of the liquid crystal display constructed as discussed above and the luminance values of the three sub-pixels 1, 2 and 3 thereof are shown in the following Table 1.

Further, the summed luminance value=the luminance value of the sub-pixel 1+ the luminance value of the sub-pixel 2+ the luminance value of the sub-pixel 3.

TABLE 1

| No. | Summed luminance | sub-pixel 1 | sub-pixel 2 | sub-pixel 3 |
|---|---|---|---|---|
| 1 | 0 | 0 | 0 | 0 |
| 2 | 1 | 0 | 0 | 1 |
| 3 | 2 | 0 | 1 | 1 |
| 4 | 3 | 1 | 1 | 1 |
| 5 | 4 | 1 | 1 | 2 |
| 6 | 5 | 1 | 2 | 2 |
| 7 | 6 | 2 | 2 | 2 |
| 8 | 7 | 2 | 2 | 3 |
| . | . | . | . | . |
| . | . | . | . | . |
| . | . | . | . | . |
| 765 | 764 | 254 | 255 | 255 |
| 766 | 765 | 255 | 255 | 255 |

Next, the aforesaid time modulation (frame rate control) method is such that a picture or image consisting of one frame is time-divided and converted into a plurality of sub-frames that constitute the picture or image, and the luminance or intensity of each of pixels constituting each sub-frame is controlled to make the luminance resolution of the bit face display high. This time modulation method brings about a problem that a flicker occurs if the number of sub-frames is increased. Accordingly, there are many cases that a picture consisting of one frame is converted into four sub-frames or so constituting the picture. In case one frame picture is converted into four sub-frames, if the luminance or intensity of each of pixels constituting each sub-frame is electronically controlled over 256 stages of gradation extending from 0 to 255 stages, then it is possible to make the luminance resolution of the liquid crystal display high theoretically up to 1024 stages of gradation (in reality, up to 1021 stages of gradation since four of the luminance value 0 are unified to one). The summed luminance value of each of the pixels of the liquid crystal display in which one picture is constituted by four sub-frames as discussed above and the luminance value of each of the pixels of each sub-frame are shown in the following Table 2.

Here, the summed luminance value=the luminance value of each pixel of the first sub-frame+the luminance value of each pixel of the second sub-frame+the luminance value of each pixel of the third sub-frame+the luminance value of each pixel of the fourth sub-frame.

TABLE 2

| No. | Summed luminance | first sub-frame | second sub-frame | third sub-frame | fourth sub-frame |
|---|---|---|---|---|---|
| 1 | 0 | 0 | 0 | 0 | 0 |
| 2 | 1 | 0 | 0 | 0 | 1 |
| 3 | 2 | 0 | 0 | 1 | 1 |
| 4 | 3 | 0 | 1 | 1 | 1 |
| 5 | 4 | 1 | 1 | 1 | 1 |
| 6 | 5 | 1 | 1 | 1 | 2 |
| 7 | 6 | 1 | 1 | 2 | 2 |
| 8 | 7 | 1 | 2 | 2 | 2 |
| . | . | . | . | . | . |
| . | . | . | . | . | . |
| . | . | . | . | . | . |
| 1020 | 1019 | 254 | 255 | 255 | 255 |
| 1021 | 1020 | 255 | 255 | 255 | 255 |

The above time modulation method enables the luminance resolution of the liquid crystal display to make higher if the number of frames is equal to or greater than four, as compared with the above-mentioned space modulation dither method in which one pixel is composed of three sub-pixels, under the same luminance control conditions.

However, the time modulation method has a problem of flicker and a basic problem that any moving picture or image can hardly be reproduced.

Now, there are some reports that if a display (monitor) of PACS (picture archiving and communication system) does not have its luminance resolution equal to or greater than 1024 stages of gradation, it is difficult to make a precise and reliable diagnosis from a medical picture or image displayed on the monitor of PACS. For this reason, the fact is that a CRT monitor that is of large size and heavy has been used as a monitor of the medical picture diagnostic apparatus or the like until the present because it has the luminance resolution equal to or greater than 1024 stages of gradation and a precise and reliable diagnosis can be made from a medical picture displayed on the CRT monitor. However, various kinds or types of medical electronic appliances, instruments, and the like are installed in a medical field, which results in a very narrow space for medical treatment. Accordingly, there is a big request from the medical field to the effect that a monitor that is of small size and light such as a liquid crystal display should be developed instead of the CRT monitor.

As stated above, the prior art liquid crystal display can display a monochrome picture or image of theoretically 766 stages of gradation by use of the space modulation dither method or 1021 stages of gradation by use of the time modulation method having a difficulty in display of a moving picture. However, the liquid crystal display has its inherent nature that as the luminance thereof (the number of stages of gradation in the above Tables 1 and 2) is lowered, reproducibility of picture is deteriorated. For this reason, a correction for improving deterioration of reproducibility is done, and as a result, even the liquid crystal display that can display a monochrome picture of theoretically 1021 stages of gradation, about 10% or more of the 1021 stages of gradation are lost due to such correction of reproducibility so that the liquid crystal display can display only a monochrome picture of substantially 900 stages of gradation or so extending from black level to white level. In other words, if a liquid crystal display can change the quantity of light passing therethrough from black level corresponding to 0% of light transmittance until white level corresponding to 100% of light transmittance, it is very suitable one. However, though it is said that the liquid crystal display can display black level, in reality, it can display merely black level corresponding to 10% or so of light transmittance.

SUMMARY OF THE INVENTION

An object of the present invention is to provide a two-dimensional monochrome bit face display having luminance resolution equal to or higher than that of a CRT monitor.

Another object of the present invention is to provide a two-dimensional monochrome bit face display having high luminance resolution equal to or higher than 1021 stages of gradation and capable of reproducing a moving picture or image.

In order to accomplish the foregoing objects, in a first aspect of the present invention, there is provided a two-dimensional monochrome bit face display having its bit face in which each of pixels is constituted by m sub-pixels (where m is an integer equal to or greater than 3) comprising: ND (neutral density) filters mounted on the m sub-pixels constituting each of the pixels respectively and transmitting light to the m sub-pixels in the proportion of values, represented by percentage, of respective terms of a power series of $\frac{1}{2}^n$ (where n is an integer from 0 to m−1) or in the proportion of approximate values thereof, and wherein luminance of each sub-pixel is electronically controlled to improve the luminance resolution of the bit face display.

In a second aspect of the present invention, there is provided a two-dimensional monochrome bit face display having its bit face in which each of pixels is constituted by m sub-pixels (where m is an integer equal to or greater than 3) comprising: mask filters mounted on the m sub-pixels constituting each of the pixels respectively and having windows that transmit light to the m sub-pixels in the proportion of values, represented by percentage, of respective terms of a power series of $\frac{1}{2}^n$ (where n is an integer from 0 to m−1) or in the proportion of approximate values thereof, and wherein luminance of each sub-pixel is electronically controlled to improve the luminance resolution of the bit face display.

In a third aspect of the present invention, there is provided a two-dimensional monochrome bit face display having its bit face in which each of pixels is constituted by m sub-pixels (where m is an integer equal to or greater than 3), wherein areas of the m sub-pixels constituting each of the pixels are set in the proportion of values, represented by percentage, of respective terms of a power series of $\frac{1}{2}^n$ (where n is an integer from 0 to m−1) or in the proportion of approximate values thereof, respectively, and luminance of each sub-pixel being electronically controlled to improve the luminance resolution of the bit face display.

In a fourth aspect of the present invention, there is provided a two-dimensional monochrome bit face display having its bit face in which each of pixels is constituted by m sub-pixels (where m is an integer equal to or greater than 3) comprising: ND filters mounted on (m−1) sub-pixels out of the m sub-pixels constituting each of the pixels respectively and transmitting light to the (m−1) sub-pixels in the proportion of values, represented by percentage, of respective terms on and after the second term of a power series of $\frac{1}{2}^n$ (where n is an integer from 0 to m−1) or in the proportion of approximate values thereof, and wherein luminance of each sub-pixel is electronically controlled to improve the luminance resolution of the bit face display.

In a fifth aspect of the present invention, there is provided a two-dimensional monochrome bit face display having its bit face in which each of pixels is constituted by m sub-pixels (where m is an integer equal to or greater than 3) comprising: mask filters mounted on (m−1) sub-pixels out of the m sub-pixels constituting each of the pixels respectively and having windows that transmit light to the (m−1) sub-pixels in the proportion of values, represented by percentage, of respective terms on and after the second term of a power series of $\frac{1}{2}^n$ (where n is an integer from 0 to m−1) or in the proportion of approximate values thereof, and wherein luminance of each sub-pixel is electronically controlled to improve the luminance resolution of the bit face display.

In a preferred embodiment, the aforesaid bit face display is a liquid crystal display, and m=3. In addition, the luminance of each sub-pixel is shifted very minutely in the direction of time base and is electronically controlled to improve the luminance resolution of the bit face display.

In a sixth aspect of the present invention, there is provided a two-dimensional monochrome bit face display having its bit face in which each of pixels is constituted by three sub-pixels comprising: ND filters mounted on the three sub-pixels constituting each of the pixels respectively and transmitting light to the three sub-pixels in the proportion of 100%, 100% and 50%, or in the proportion of 100%, 50% and 50%, and wherein luminance of each sub-pixel is electronically controlled to improve the luminance resolution of the bit face display.

In a seventh aspect of the present invention, there is provided a two-dimensional monochrome bit face display having its bit face in which each of pixels is constituted by three sub-pixels comprising: mask filters mounted on the three sub-pixels constituting each of the pixels respectively and having windows that transmit light to the three sub-pixels in the proportion of 100%, 100% and 50%, or in the proportion of 100%, 50% and 50%, and wherein luminance of each sub-pixel is electronically controlled to improve the luminance resolution of the bit face display.

In a eighth aspect of the present invention, there is provided a two-dimensional monochrome bit face display having its bit face in which each of pixels is constituted by three sub-pixels, wherein areas of the three sub-pixels constituting each of the pixels are set in the proportion of 100%, 100% and 50%, or in the proportion of 100%, 50% and 50%, respectively, and luminance of each sub-pixel being electronically controlled to improve the luminance resolution of the bit face display.

In a ninth aspect of the present invention, there is provided a two-dimensional monochrome bit face display having its bit face in which each of pixels is constituted by three sub-pixels, wherein a ND filter that transmits light therethrough by the quantity of light of 50% is mounted on one or two sub-pixels out of the three sub-pixels constituting each of the pixels, and luminance of each sub-pixel is electronically controlled to improve the luminance resolution of the bit face display.

In a tenth aspect of the present invention, there is provided a two-dimensional monochrome bit face display having its bit face in which each of pixels is constituted by three sub-pixels, wherein a mask filter having a window that transmits light therethrough by the quantity of light of 50% is mounted on one or two out of the three sub-pixels constituting each of the pixels, and luminance of each sub-pixel is electronically controlled to improve the luminance resolution of the bit face display.

In a preferred embodiment, the aforesaid bit face display is a liquid crystal display, and the luminance of each sub-pixel is shifted very minutely in the direction of time base and is electronically controlled to improve the luminance resolution of the bit face display.

According to the present invention, with simple construction or configuration, the luminance resolution of a two-dimensional monochrome bit face display such as a liquid crystal display can be made high up to a value equal to or higher than that of a CRT monitor. Accordingly, the two-dimensional monochrome bit face display can be conveniently used as a monochrome picture or image display for various kinds of medical electronic appliances, instruments, and the like. In addition, since only the space modulation dither method is adopted, any problem of flicker does not occur and hence a moving picture can be reproduced.

DETAILED DESCRIPTION OF THE PREFERRED EMBODIMENT

The preferred embodiments of the present invention will now be described in detail with reference to the accompanying drawings. The present invention may, however, be embodied in many different forms and should not be construed as limited to the embodiments set forth hereinafter; rather, the embodiments are provided so that this disclosure will be thorough and complete, and will fully convey the scope of the invention to those skilled in the art.

First, the first embodiment of the two-dimensional monochrome bit face display according to the present invention will be described in detail with reference to FIG. 1.

Figure 1A:
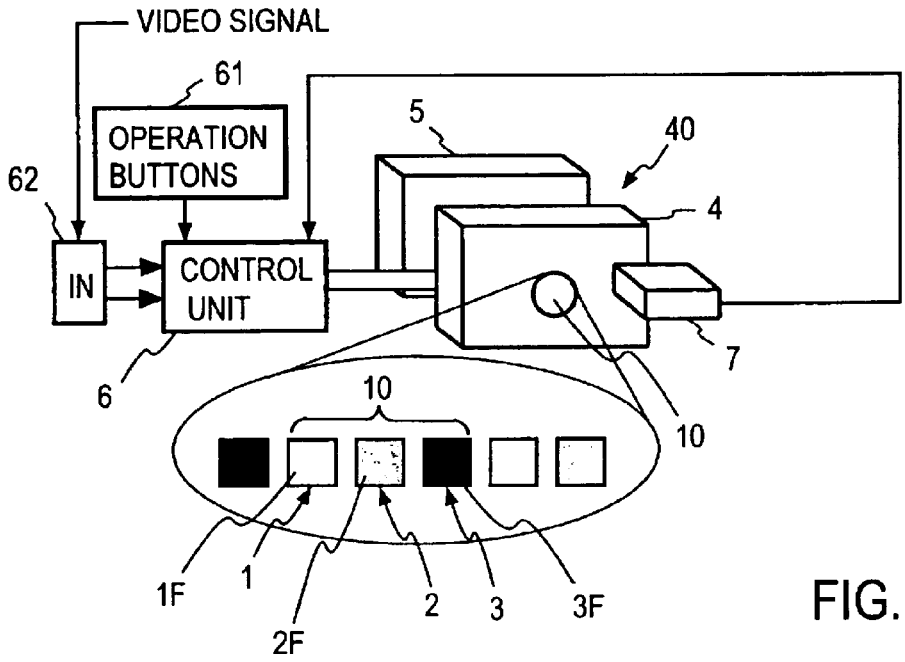
FIG. 1A is a diagrammatical view illustrating the first embodiment of the two-dimensional monochrome bit face display according to the present invention.
Figure 1B:
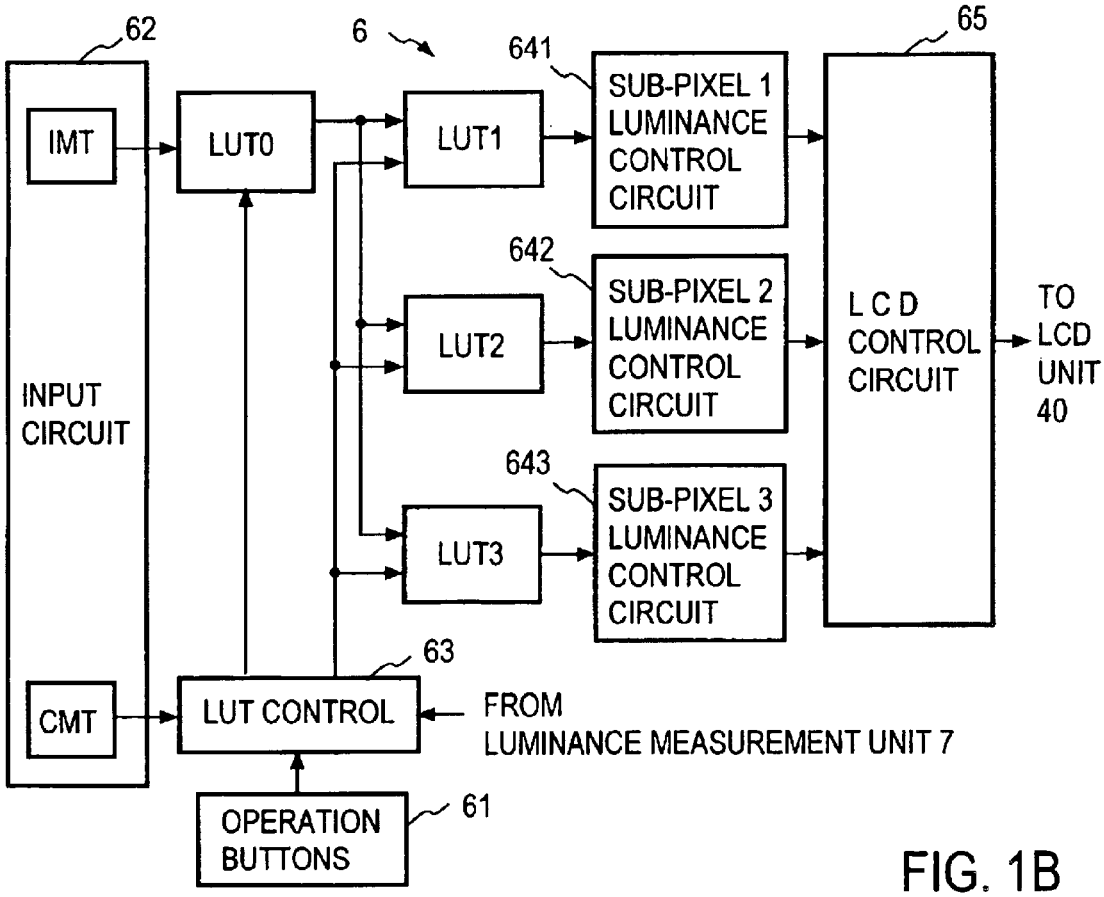
FIG. 1B is a block diagram showing one specified example of the control unit shown in FIG. 1A.

FIG. 1A is a diagrammatical view illustrating the first embodiment of the two-dimensional monochrome bit face display in which the present invention is applied to a liquid crystal display. This display comprises: a liquid crystal display unit 40 including a liquid crystal display face (liquid crystal panel) 4 composed of a many number of pixels, and a backlight 5; a control unit 6 that controls luminance or intensity of each of the pixels of the liquid crystal panel 4; operation buttons 61 for inputting a various kinds of commands into the control unit 6; an input circuit (IN) 62 that receives a video or picture or image signal (hereinafter, referred to simply as video signal) and a control command transmitted from the outside; and a luminance measurement unit 7 that measures luminance or brightness of the top surface of the liquid crystal panel 4 and inputs the measured luminance into the control unit 6. FIG. 1B is a block diagram showing one specified example of the control unit 6 shown in FIG. 1A together with the operation buttons 61 and the input circuit 62.

The display of the first embodiment adopts the space modulation dither method discussed above, and hence, as shown in explanatory diagram in FIG. 1A, one pixel 10 is constituted by three sub-pixels 1, 2 and 3. In this embodiment, on the three sub-pixels constituting each of the pixels of the liquid crystal panel 4 are mounted ND (neutral density) filters having different light transmittances (light transmission factors) from one another, respectively. For example, an ND filter 1F having its light transmittance of 100% is mounted on the sub-pixel 1 of each pixel, an ND filter 2F having its light transmittance of 50% is mounted on the sub-pixel 2 of each pixel, and an ND filter 3F having its light transmittance of 25% is mounted on the sub-pixel 3 of each pixel.

In a well known and conventionally used color liquid crystal display, R (red), G (green) and B (blue) filters are formed as a thin film between the glass substrate and the transparent electrode thereof. In the first embodiment, instead of forming the R, G and B filters therebetween, the ND filter 1F having its light transmittance of 100%, the ND filter 2F having its light transmittance of 50%, and the ND filter 3F having its light transmittance of 25% are formed between the glass substrate and the transparent electrode of the color liquid crystal display. This method of mounting ND filters may be said that it is a most suitable one since ND filters are formed in place of R, G and B filters.

As shown in FIG. 1B, the control unit 6 comprises: a sub-pixel 1 luminance control circuit 641 that controls luminance or intensity of the sub-pixel 1 of each of the pixels of the liquid crystal panel 4; a sub-pixel 2 luminance control circuit 642 that controls luminance or intensity of the sub-pixel 2 of each of the pixels; a sub-pixel 3 luminance control circuit 643 that controls luminance or intensity of the sub-pixel 3 of each of the pixels; first, second and third look-up table circuits LUT1, LUT2 and LUT3 provided respectively at the input sides of these luminance control circuits 641, 642 and 643, each supplying predetermined luminance information to corresponding one of the luminance control circuits; fourth look-up table circuit LUT0 that is able to optionally change a luminance curve of a video signal supplied from the input circuit 62; a look-up table control circuit (hereinafter, referred to as LUT control circuit) 63 that has controls of writing a look-up table in one or more of the four look-up table circuits LUT0–LUT3, altering the look-up table already written in one or more of the four look-up table circuits LUT0–LUT3, deleting the look-up table already written in one or more of the four look-up table circuits LUT0–LUT3, and the like; and a liquid crystal display control circuit (LCD control circuit) 65 that controls luminance of the liquid crystal panel 4 of the liquid crystal display unit 40 on the basis of luminance control signals outputted respectively from the sub-pixel 1 luminance control circuit 641, the sub-pixel 2 luminance control circuit 642 and the sub-pixel 3 luminance control circuit 643.

The sub-pixel 1 luminance control circuit 641, the sub-pixel 2 luminance control circuit 642 and the sub-pixel 3 luminance control circuit 643 are configured, in this embodiment, such that they output luminance control signals each of which is constituted by 8 bits for displaying 256 stages of gradation, respectively. The first, second and third look-up table circuits LUT1, LUT2 and LUT3 are ones in which rewritable look-up tables of 11 bit input/8 bit output are written. The fourth look-up table circuit LUT0 is not an indispensable component to the present invention, and is used herein as a circuit device that is capable of freely changing the luminance curve of a monochrome video signal sent from an external circuit such as a computer or the like. In this embodiment, the fourth look-up table circuit LUT0 will be explained as a look-up table circuit in which a rewritable look-up table of 11 bit input/11 bit output is written.

A monochrome video signal sent from an external circuit such as a computer or the like is received by a video input terminal IMT of the input circuit 62, and is inputted into the fourth look-up table circuit LUT0. On the other hand, a control command sent from the external circuit such as a computer or the like is received by a control command input terminal CMT of the input circuit 62, and is sent to the LUT control circuit 63.

The LUT control circuit 63 writes in the first, second and third look-up table circuits LUT1, LUT2 and LUT3 look-up tables that are optimal for the three sub-pixels 1, 2 and 3 constituting each pixel, respectively, with reference to information inputted from the luminance measurement unit 7 if the need arises. In addition, the LUT control circuit 63 previously writes in the fourth look-up table circuit LUT0 DICOM (digital imaging and communications in medicine) standard curve, an exponential curve, a linear curve, and/or other data on the basis of a control command supplied from the control command input terminal CMT of the input circuit 62 or a command inputted thereto through the operation buttons 61.

As the sub-pixel 1, sub-pixel 2 and sub-pixel 3 luminance control circuits 641, 642 and 643, and the liquid crystal display control circuit 65, there may be used luminance control circuits provided respectively for R, G and B colors and a circuit having the same circuit construction as that of the liquid crystal display control circuit 65, these luminance control circuits for R, G and B colors and the circuit being commonly used in a conventional color liquid crystal display.

A digital monochrome video signal of 11 bits is inputted into the video input terminal IMT of the input circuit 62 from an external circuit such as a computer or the like. The digital monochrome video signal of 11 bits is supplied to the fourth look-up table circuit LUT0 in which it is converted into data of a specified luminance curve. The monochrome video signal of 11 bits converted into data of a specified luminance curve by the fourth look-up table circuit LUT0 is supplied to all of the first, second and third look-up table circuits LUT1, LUT2 and LUT3. These look-up table circuits LUT1, LUT2 and LUT3 output gradation values of the corresponding sub-pixels 1, 2 and 3 as data of 8 bits respectively by use of their look-up tables already written therein. The sub-pixel 1 luminance control circuit 641, the sub-pixel 2 luminance control circuit 642 and the sub-pixel 3 luminance control circuit 643 output to the liquid crystal display control circuit 65, respectively, luminance control signals for controlling luminances of the corresponding sub-pixels over 256 stages of gradation in accordance with the data of 8 bits inputted thereto respectively from the corresponding look-up table circuits LUT1, LUT2 and LUT3.

In such manner, if respective luminances of the three sub-pixels 1, 2 and 3 constituting each pixel are controlled over 256 stages of gradation in accordance with the control signals each being of 8 bits, the luminance resolution of one pixel becomes 1786 stages of gradation as shown in the following Table 3, and hence it is possible to improve the luminance resolution of the liquid crystal display up to 1786 stages of gradation. Moreover, since only the space modulation dither method is adopted, any problem of flicker does not occur and hence a moving picture can be reproduced. Furthermore, the liquid crystal display unit can be manufactured by substituting ND filters for the R, G and B filters of the liquid crystal display unit in which each of the pixels is constituted by three sub-pixels developed in a color liquid crystal display as well as control circuits commonly used in a conventional color liquid crystal display can be utilized almost as they are as the control circuits for the liquid crystal display unit. Accordingly, there is also obtained an advantage that the liquid crystal display of the first embodiment can easily be manufactured.

In case, in the liquid crystal display of the first embodiment, respective luminances of the three sub-pixels 1, 2 and 3 constituting each pixel are electronically controlled over 256 stages of gradation extending from 0 to 255 stages in accordance with control signals each being of 8 bits, if the luminance value of the sub-pixel 1 on which the ND filter 1F having its light transmittance of 100% is mounted is SB1, the luminance value of the sub-pixel 2 on which the ND filter 2F having its light transmittance of 50% is mounted is SB2, and the luminance value of the sub-pixel 3 on which the ND filter 3F having its light transmittance of 25% is mounted is SB3, the summed luminance value Y of one pixel is obtained from the following equation (1).

$$Y=SB1+SB2+SB3 \quad (1)$$

The summed luminance value Y monotonically increases as shown in the following Table 3 with the luminance value 0.25 of the sub-pixel 3 as the least unit.

TABLE 3

| No. | Y | SB1 | SB2 | SB3 |
|---|---|---|---|---|
| 1 | 0.00 | 0 | 0 | 0 |
| 2 | 0.25 | 0 | 0 | 1 |
| 3 | 0.50 | 0 | 1 | 0 |

TABLE 3-continued

| No. | Y | SB1 | SB2 | SB3 |
|---|---|---|---|---|
| 4 | 0.75 | 0 | 1 | 1 |
| 5 | 1.00 | 1 | 0 | 0 |
| 6 | 1.25 | 1 | 0 | 1 |
| 7 | 1.50 | 1 | 1 | 0 |
| 8 | 1.75 | 1 | 1 | 1 |
| . | . | . | . | . |
| . | . | . | . | . |
| . | . | . | . | . |
| 1785 | 446.00 | 255 | 255 | 254 |
| 1786 | 446.25 | 255 | 255 | 255 |

Further, there are a plurality of ways to select the luminance values of 1786 stages, and the following way of increasing the luminance values, for example, as shown in the following Table 4 may be taken.

TABLE 4

| No. | Y | SB1 | SB2 | SB3 |
|---|---|---|---|---|
| 1 | 0.00 | 0 | 0 | 0 |
| 2 | 0.25 | 0 | 0 | 1 |
| 3 | 0.50 | 0 | 0 | 2 |
| 4 | 0.75 | 0 | 0 | 3 |
| 5 | 1.00 | 0 | 0 | 4 |
| 6 | 1.25 | 0 | 0 | 5 |
| 7 | 1.50 | 0 | 0 | 6 |
| 8 | 1.75 | 0 | 0 | 7 |
| . | . | . | . | . |
| . | . | . | . | . |
| . | . | . | . | . |
| 1785 | 446.00 | 255 | 255 | 254 |
| 1786 | 446.25 | 255 | 255 | 255 |

Next, the second embodiment of the two-dimensional monochrome bit face display according to the present invention will be described in detail with reference to FIG. 2. This second embodiment is one in which the present invention is also applied to a liquid crystal display. However, the second embodiment is arranged such that the luminances of the three sub-pixels 1, 2 and 3 constituting one pixel in the first embodiment are very minutely shifted in the direction of time base to convert a picture or image of one frame into a picture or image of two frames and the luminance of one pixel is displayed by the summed luminance value obtained from addition of the luminance of a pixel of one of the two frames and the luminance of the corresponding pixel of the other of the two frames. This results in a further improvement in the luminance resolution of the liquid crystal display.

Figure 2A:
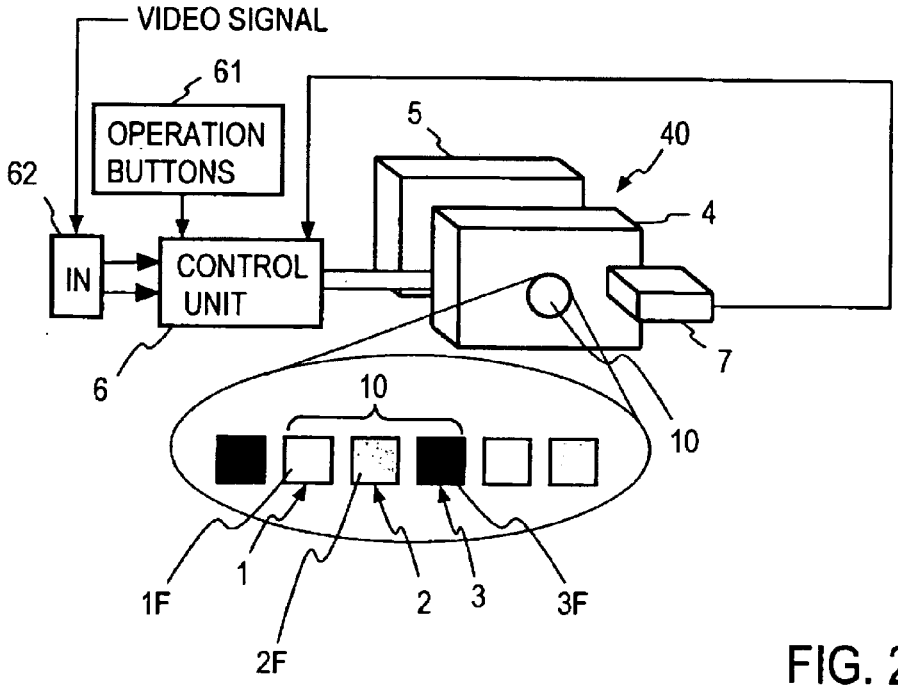
FIG. 2A is a diagrammatical view illustrating the second embodiment of the two-dimensional monochrome bit face display according to the present invention.
Figure 2B:
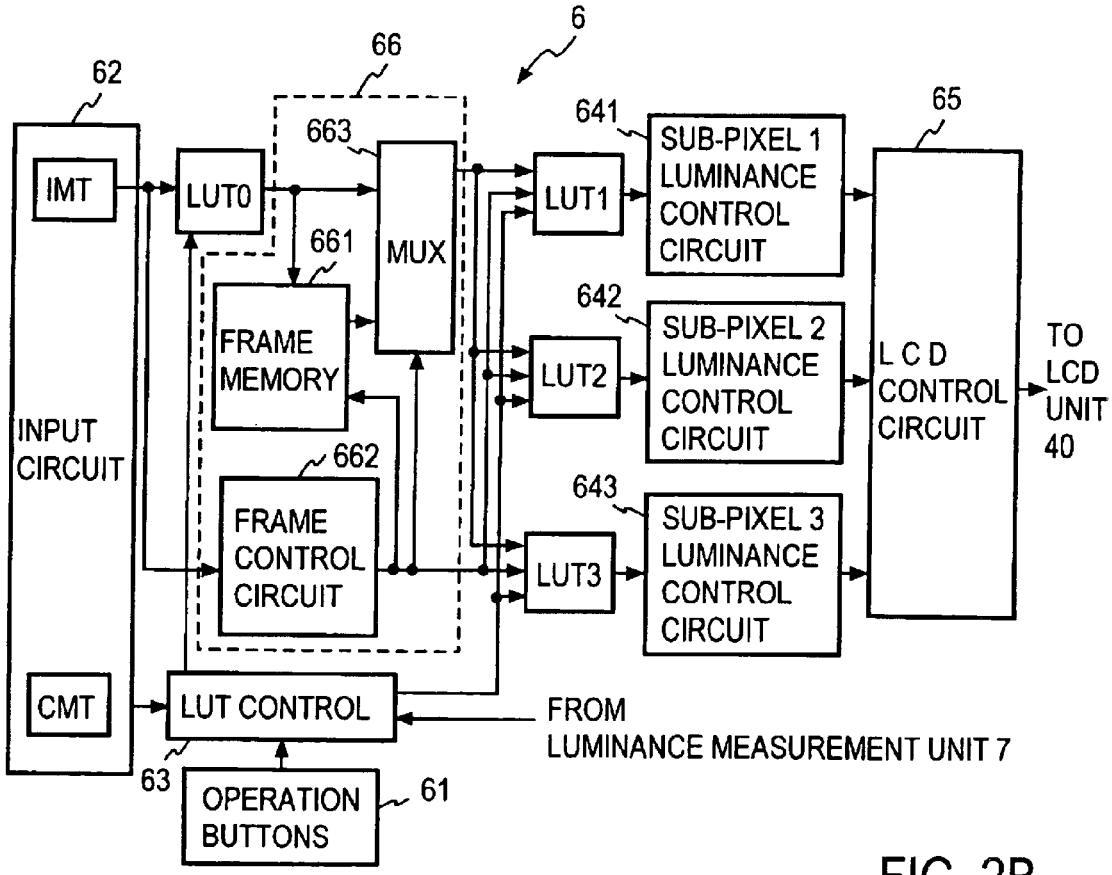
FIG. 2B is a block diagram showing one specified example of the control unit shown in FIG. 2A.

As shown in FIG. 2A, the second embodiment of the liquid crystal display has the same diagrammatical construction as that of the first embodiment discussed above. However, as shown in FIG. 2B, in the display of the second embodiment, the control unit 6 further includes a time base control circuit 66 added thereto which comprises a frame memory 661, a frame control circuit 662 and a multiplexer (MUX) 663. Other construction of the second embodiment is substantially the same as that of the first embodiment, and portions and elements or components in FIG. 2 corresponding to those in FIG. 1 will be denoted by the same reference characters attached thereto and the explanation thereof will be omitted unless necessary.

There are some methods of carrying out time base modulation, and in this second embodiment, a time base modulation method will be explained, in which the number of frames of a video signal sent from a computer or the like is identical with that of a picture or image reproduced on the liquid crystal display, and a picture or image of every other frame is converted into one constituted by two frames. Further, in this second embodiment, the first, second and third look-up table circuits LUT1, LUT2 and LUT3 will be used as look-up table circuits in which rewritable look-up tables of 13 bit input/8 bit output will be written, and the fourth look-up table circuit LUT0 will be used as a look-up table circuit in which a rewritable look-up table of 12 bit input/12 bit output will be written.

The frame control circuit 662 detects frame number of a video signal having been sent to the input circuit 62 at present from a computer or the like by checking a vertical synchronizing signal included in the video signal. When the frame control circuit 662 decides from the video signal supplied thereto from the video input terminal IMT of the input circuit 62 that the frame number of the video signal is Nth frame, it supplies control signals to the frame memory 661, the multiplexer 663, and the first, second and third look-up table circuits LUT1, LUT2 and LUT3.

The multiplexer 663 connects its one input terminal that is connected to the fourth look-up table circuit LUT0 with its output terminal in response to the control signal from the frame control circuit 63, thereby to supply the video signal of 12 bits of Nth frame supplied from the fourth look-up table circuit LUT0 to the first, second and third look-up table circuits LUT1, LUT2 and LUT3. The video signal of 12 bits outputted from the multiplexer 663 is given to lower significant 12 bit inputs (12 bit inputs except most significant bit input) of each of the first, second and third look-up table circuits LUT1, LUT2 and LUT3. The frame memory 661 stores the video signal of 12 bits of Nth frame supplied from the fourth look-up table circuit LUT0. The frame control circuit 662 supplies the control signal to most significant bit input of each of the first, second and third look-up table circuits LUT1, LUT2 and LUT3 to directly indicate to them that frame number of the video signal is Nth at present.

The frame control circuit 662 supplies control signals to the frame memory 661 and the multiplexer 663 at the time that a very minute time has passed, at the time that a vedio signal of next (N+1)th frame has been sent to the input circuit 62 in this embodiment. The frame memory 661 is controlled by the control signal from the frame control circuit 662 to output the preceding video signal of 12 bits of Nth frame already stored therein to the multiplexer 663, and the multiplexer 663 is controlled by the control signal from the frame control circuit 662 to disconnect the one input terminal that is connected to the fourth look-up table circuit LUT0 from the output terminal thereof and to connect the other input terminal that is connected to the frame memory 661 to the output terminal thereof. As a result of such control of the frame control circuit 662, the video signal of 12 bits of Nth frame already stored in the frame memory 661 is supplied through the multiplexer 663 to the lower significant 12 bit inputs of each of the first, second and third look-up table circuits LUT1, LUT2 and LUT3.

Since the frame memory 661 is instructed by the frame control circuit 662 so as to output the video signal of Nth frame already stored therein, the next video signal of (N+1) th frame is not stored in the frame memory 661. In addition, the one input terminal of the multiplexer 663 that is connected to the fourth look-up table circuit LUT0 is not connected to the output terminal thereof, and hence the multiplexer 663 does not output the video signal of (N+1)th frame. In other words, the frame control circuit 662 controls such that Nth frame already stored in the frame memory 661 in place of (N+1)th frame is outputted to the first, second and third look-up table circuits LUT1, LUT2 and LUT3. However, the frame control circuit 662 supplies the control signal to the most significant bit input of each of the first, second and third look-up table circuits LUT1, LUT2 and LUT3 to indicate to them that frame number of the video signal is (N+1)th at present, and hence these look-up table circuits LUT1, LUT2 and LUT3 output data of 8 bits indicating gradation values of the sub-pixels 1, 2 and 3 of (N+1)th frame, respectively.

When a video signal of next (N+2)th frame has been sent to the input circuit 62, the frame control circuit 662 supplies the control signals to the frame memory 661, the multiplexer 663, and the first, second and third look-up table circuits LUT1, LUT2 and LUT3. By these control signals, the multiplexer 663 connects the one input terminal that is connected to the fourth look-up table circuit LUT0 with the output terminal, thereby to supply the video signal of 12 bits of (N+2)th frame supplied from the fourth look-up table circuit LUT0 to the first, second and third look-up table circuits LUT1, LUT2 and LUT3. The frame memory 661 stores the video signal of 12 bits of (N+2)th frame supplied from the fourth look-up table circuit LUT0. The frame control circuit 662 supplies the control signal to the most significant bit input of each of the first, second and third look-up table circuits LUT1, LUT2 and LUT3 to directly indicate to them that frame number of the video signal is (N+2)th at present. Thereafter, the same control and operation as those described above will be repetitively carried out.

By the above-mentioned control of the frame control circuit 662, the video signal of 12 bits of Nth frame is successively inputted into the lower significant 12 bit inputs of each of the first, second and third look-up table circuits LUT1, LUT2 and LUT3, two times, and subsequently thereto, the video signal of 12 bits of (N+2)th frame is successively inputted into the lower significant 12 bit inputs of each of the first, second and third look-up table circuits LUT1, LUT2 and LUT3, two times, and subsequently thereto, in like manner, the video signal of 12 bits of every other frame is successively inputted into the lower significant 12 bit inputs of each of the first, second and third look-up table circuits LUT1, LUT2 and LUT3, two times. These look-up table circuits LUT1, LUT2 and LUT3 output gradation values of the corresponding sub-pixels 1, 2 and 3 by use of their look-up tables previously written therein as data of 8 bits, respectively. Accordingly, if it is defined that the video signal of Nth frame inputted directly into the look-up table circuits LUT1, LUT2 and LUT3 from the fourth look-up table circuit LUT0 through the multiplexer 663 is the first video signal of frame N, and the video signal of Nth frame inputted into the look-up table circuits LUT1, LUT2 and LUT3 from the frame memory 661 through the multiplexer 663 is the second video signal of frame N, the first, second and third look-up table circuits LUT1, LUT2 and LUT3 output, as to the first video signal of frame N, data of 8 bits that indicate gradation values for the sub-pixels 1, 2 and 3 of Nth frame, respectively, and, as to the second video signal of frame N, data of 8 bits that indicate gradation values for the sub-pixels 1, 2 and 3 of (N+1)th frame, respectively.

The sub-pixel 1 luminance control circuit 641, the sub-pixel 2 luminance control circuit 642 and the sub-pixel 3 luminance control circuit 643 sequentially output, in accordance with the data of 8 bits inputted thereinto respectively from the corresponding look-up table circuits LUT1, LUT2 and LUT3, luminance or intensity control signals for controlling the luminances of the corresponding sub-pixels over 256 stages of gradation to the liquid crystal control circuit 65, respectively.

In such manner, the two luminance control signals each having 8 bits based on two video signals one being the first video signal of frame N and the other being the second video signal of frame N are supplied in order to the liquid crystal display unit 40 through the liquid crystal display control circuit 65, and so two video signals of the same Nth frame are displayed in order on the liquid crystal panel 4 of the liquid crystal display unit 40.

Pictures or images displayed on the liquid crystal panel 4 with a very minute time difference between the pictures or images (usually, the number of frames is 30 per second or so, and hence a time difference between frames is too minute to perceive) is recognized as a difference of gradation due to the nature of the retina. Therefore, according to the second embodiment, if luminance of each of three sub-pixels 1, 2 and 3 constituting each pixel is controlled by the control signal of 8 bits over 256 stages of gradation as in the above-mentioned first embodiment, luminance control of 1786 stages of gradation as to the first video signal of frame N and luminance control of 1786 stages of gradation as to the second video signal of frame N can be done, and so the luminance control of 3572 stages of gradation in total (in reality, up to 3572 stages of gradation since two of the luminance value 0 are unified to one) can be done.

Explaining concretely, in the liquid crystal display of the second embodiment, in case luminance of each of three sub-pixels 1, 2 and 3 constituting each pixel is electronically controlled by the control signal of 8 bits over 256 stages of gradation, assuming that regarding the first video signal of frame N, the luminance value of the sub-pixel 1 on which the ND filter IF having light transmittance of 100% is mounted is SB11, the luminance value of the sub-pixel 2 on which the ND filter 2F having light transmittance of 50% is mounted is SB12, and the luminance value of the sub-pixel 3 on which the ND filter 3F having light transmittance of 25% is mounted is SB13, and that regarding the second video signal of frame N, the luminance value of the sub-pixel 1 on which the ND filter 1F having light transmittance of 100% is mounted is SB21, the luminance value of the sub-pixel 2 on which the ND filter 2F having light transmittance of 50% is mounted is SB22, and the luminance value of the sub-pixel 3 on which the ND filter 3F having light transmittance of 25% is mounted is SB23, then the summed luminance value Y of one pixel is obtained from the following equation (2).

$$Y=SB11+SB12+SB13+SB21+SB22+SB23 \quad (2)$$

The summed luminance value Y monotonically increases as shown in the following Table 5 with the luminance value 0.25 of the sub-pixel 3 as the least unit, and luminance values of 3571 stages can be obtained.

TABLE 5

| No. | SB11 | SB12 | SB13 | SB21 | SB22 | SB23 | Y |
|---|---|---|---|---|---|---|---|
| 1 | 0 | 0 | 0 | 0 | 0 | 0 | 0.00 |
| 2 | 0 | 0 | 0 | 0 | 0 | 1 | 0.25 |
| 3 | 0 | 0 | 1 | 0 | 0 | 1 | 0.50 |
| 4 | 0 | 0 | 1 | 0 | 1 | 0 | 0.75 |
| 5 | 0 | 0 | 1 | 0 | 1 | 1 | 1.00 |
| 6 | 0 | 1 | 0 | 0 | 1 | 1 | 1.25 |
| 7 | 0 | 1 | 1 | 0 | 1 | 1 | 1.50 |
| 8 | 0 | 1 | 1 | 1 | 0 | 0 | 1.75 |
| . | . | . | . | . | . | . | . |
| . | . | . | . | . | . | . | . |
| . | . | . | . | . | . | . | . |
| 3570 | 255 | 255 | 255 | 255 | 255 | 254 | 892.25 |
| 3571 | 255 | 255 | 255 | 255 | 255 | 255 | 892.50 |

Thus, there is provided a two-dimensional monochrome liquid crystal display having its luminance resolution of 3571 stages. As discussed above, the liquid crystal display of the second embodiment has not only its luminance resolution of about twice that of the first embodiment but also advantages that a moving picture can be reproduced, the liquid crystal display of the second embodiment can easily be manufactured, and so on, as in the first embodiment. Further, there are a plurality of ways to select the luminance values of 3571 stages, as in the first embodiment.

In the first and the second embodiments, though an ND filter having light transmittance of 100% is mounted on one of the three sub-pixels, to mount the ND filter having light transmittance of 100% on one sub-pixel is equivalent to that no ND filter is mounted on one sub-pixel. Accordingly, the same result may be obtained even in case no ND filter is mounted on one sub-pixel, an ND filter having light transmittance of 50% is mounted on one of the remaining two sub-pixels, and an ND filter having light transmittance of 25% is mounted on the other of the remaining two sub-pixels.

In addition, in the second embodiment, in case a video signal sent from a computer or the like is a still picture or still image, it is unnecessary to output a picture or image of the same frame two times, and hence a transmitted picture or image may be inputted directly to the first, second and third look-up table circuits LUT1, LUT2 and LUT3 without storing it in the frame memory 661. In this case, it is arranged that luminance of each of three sub-pixels 1, 2 and 3 constituting each pixel of Nth frame and (N+1)th frame is controlled by a control signal of, for example, 8 bits to display luminance of each pixel by the summed luminance value of both Nth and (N+1)th frames. Consequently, the frame memory 661 and the multiplexer 663 may be omitted. Moreover, if the function of the frame control circuit 662 is transferred to the LUT control circuit 63, the frame control circuit 662 also may be omitted. In other words, in case a video signal sent from a computer or the like is a still picture or still image, it is possible to make the luminance resolution of the liquid crystal display of the second embodiment high such as about twice that of the first embodiment or so even if the time base control circuit 66 is not provided.

Next, the third embodiment of the two-dimensional monochrome bit face display according to the present invention will be described in detail with reference to FIG. 3.

Figure 3A:
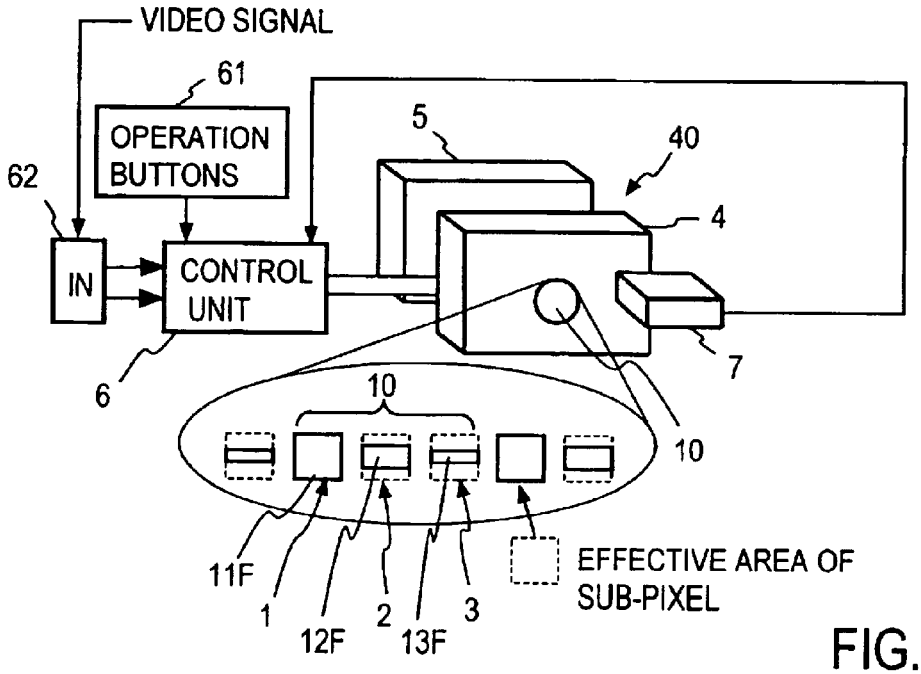
FIG. 3A is a diagrammatical view illustrating the third embodiment of the two-dimensional monochrome bit face display according to the present invention.
Figure 3B:
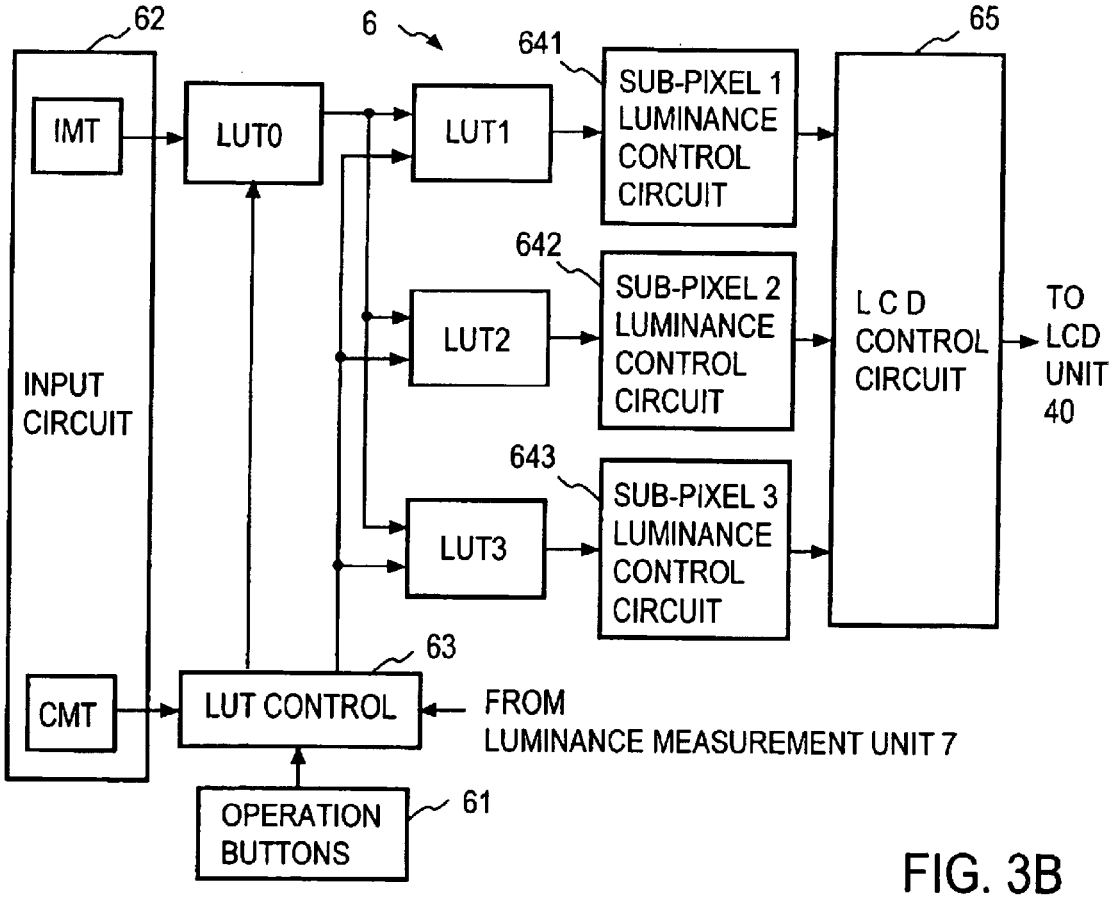
FIG. 3B is a block diagram showing one specified example of the control unit shown in FIG. 3A.

FIG. 3A is a diagrammatical view showing the third embodiment of the two-dimensional monochrome bit face display in which the present invention is applied to a liquid crystal display. As in the first embodiment, this display comprises: a liquid crystal display unit 40 including a liquid crystal display face (liquid crystal panel) 4 composed of a many number of pixels, and a backlight 5; a control unit 6 that controls luminance or intensity of each of the pixels of the liquid crystal panel 4; operation buttons 61 for inputting a various kinds of commands into the control unit 6; an input circuit (IN) 62 that receives a video or picture or image signal (hereinafter, referred to simply as video signal) and a control command transmitted from the outside; and a luminance measurement unit 7 that measures luminance or brightness of the top surface of the liquid crystal panel 4 and inputs the measured luminance into the control unit 6. FIG. 3B is a block diagram showing one specified example of the control unit 6 shown in FIG. 3A together with the operation buttons 61 and the input circuit 62.

The display of the third embodiment adopts the space modulation dither method discussed above, and hence, as shown in explanatory diagram in FIG. 3A, one pixel 10 is constituted by three sub-pixels 1, 2 and 3. In this embodiment, on the three sub-pixels constituting each of the pixels of the liquid crystal panel 4 are mounted mask filters having windows or openings of different sizes for making areas of sub-pixels through which light passes different, respectively. Hereinafter, such filters will be referred to simply as mask filters. For example, as shown in FIG. 3A, on the sub-pixel 1 of each pixel is mounted a mask filter 11F for making light pass through all over the area of the sub-pixel 1, that is, for making light pass through 100% of the area of the sub-pixel 1, on the sub-pixel 2 of each pixel is mounted a mask filter 12F for making light pass through 50% of the area of the sub-pixel 2, and on the sub-pixel 3 of each pixel is mounted a mask filter 13F for making light pass through 25% of the area of the sub-pixel 3. In other words, the mask filter 11F has its window the size of which is equal to the effective area of the sub-pixel 1, the mask filter 12F has its window the size of which is equal to a half of the effective area of the sub-pixel 2, and the mask filter 13F has its window the size of which is equal to a quarter of the effective area of the sub-pixel 3.

A work or operation for mounting the above-mentioned mask filters on the sub-pixels of each of all pixels of the liquid crystal panel 4 respectively is easy because in a well known and conventionally used color liquid crystal display, instead of forming the R, G and B filters, the mask filters of 100%, 50% and 25% may be formed. Therefore, there occurs no problem in manufacture of the liquid crystal panel 4.

The control unit 6 has the same construction as that of the first embodiment discussed before as shown in FIG. 3B, and hence portions and elements or components in FIG. 3B corresponding to those in FIG. 1B will be denoted by the same reference characters attached thereto, and the operations and explanation thereof will be omitted.

In the liquid crystal display of the third embodiment, if respective luminances of the three sub-pixels 1, 2 and 3 constituting each pixel are electronically controlled over 256 stages of gradation extending from 0 to 255 stages in accordance with control signals each being of 8 bits, as in the first embodiment, the luminance resolution of one pixel becomes 1786 stages of gradation as shown in the Table 3 already described, and hence it is possible to make the luminance resolution of the liquid crystal display high up to 1786 stages of gradation. In addition, since only the space modulation dither method is adopted, any problem of flicker does not occur and hence a moving picture can be reproduced. Furthermore, the liquid crystal display unit can be manufactured by substituting the mask filters for the R, G and B filters of the liquid crystal display unit in which each of the pixels is constituted by three sub-pixels developed in a color liquid crystal display as well as control circuits commonly used in a conventional color liquid crystal display can be utilized almost as they are as the control circuits for the liquid crystal display unit. Accordingly, there is also obtained an advantage that the liquid crystal display of the third embodiment can easily be manufactured.

Next, the fourth embodiment of the two-dimensional monochrome bit face display according to the present invention will be described in detail with reference to FIG. 4. This fourth embodiment is one in which the present invention is also applied to a liquid crystal display. However, the fourth embodiment is arranged such that the luminances of the three sub-pixels 1, 2 and 3 constituting one pixel in the third embodiment are very minutely shifted in the direction of time base to convert a picture or image of every other frame into a picture or image consisting of two frames and the luminance of one pixel is displayed by the summed luminance value obtained from addition of the luminance of a pixel of one of the two frames and the luminance of the corresponding pixel of the other of the two frames. This results in a further improvement in the luminance resolution of the liquid crystal display.

Figure 4A:
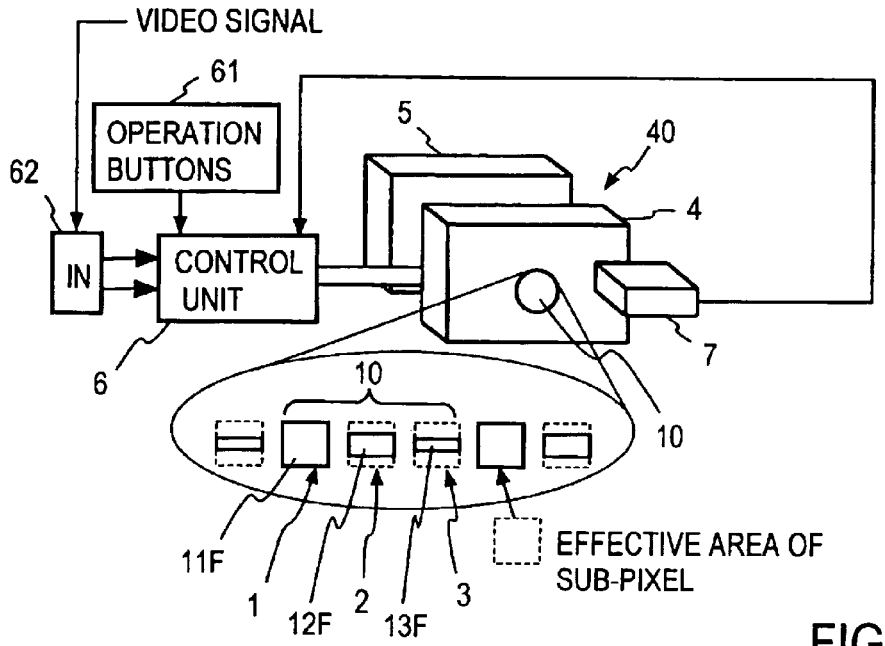
FIG. 4A is a diagrammatical view illustrating the fourth embodiment of the two-dimensional monochrome bit face display according to the present invention.
Figure 4B:
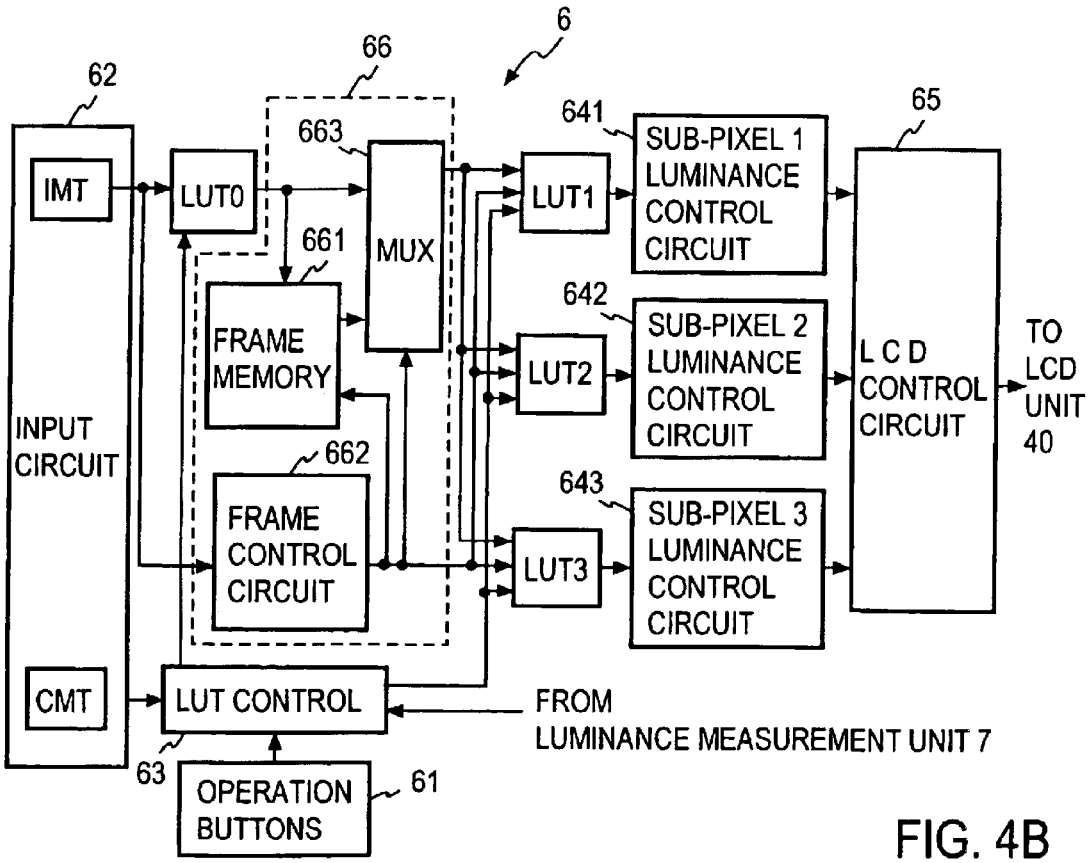
FIG. 4B is a block diagram showing one specified example of the control unit shown in FIG. 4A.

As shown in FIG. 4A, the fourth embodiment of the liquid crystal display has the same diagrammatical construction as that of the third embodiment discussed above. However, as shown in FIG. 4B, in the display of the fourth embodiment, the control unit 6 further includes a time base control circuit 66 added thereto which comprises a frame memory 661, a frame control circuit 662 and a multiplexer (MUX) 663. The circuit construction of this control unit 6 is the same as that of the second embodiment, and portions and elements or components in FIG. 4B corresponding to those in FIG. 2B will be denoted by the same reference characters attached thereto, and the operations and explanation thereof will be omitted.

In the fourth embodiment, too, in accordance with the control of the frame control circuit 662, the two luminance control signals each having 8 bits based on two video signals one being the first video signal of frame N and the other being the second video signal of frame N are supplied in regular sequence to the liquid crystal display unit 40 through the liquid crystal display control circuit 65, and so two video signals of the same Nth frame are displayed in regular sequence on the liquid crystal panel 4 of the liquid crystal display unit 40. Accordingly, if luminance of each of three sub-pixels 1, 2 and 3 constituting each pixel is controlled by a control signal of 8 bits over 256 stages of gradation, luminance control of 1786 stages of gradation as to the first video signal of frame N and luminance control of 1786 stages of gradation as to the second video signal of frame N can be done, and so the luminance control of 3572 stages of gradation in total (in reality, up to 3572 stages of gradation since two of the luminance value 0 are unified to one) can be done.

Explaining concretely, in the liquid crystal display of the fourth embodiment, in case luminance of each of three sub-pixels 1, 2 and 3 constituting each pixel is electronically controlled by the control signal of 8 bits over 256 stages of gradation extending from 0 to 255 stages, assuming that regarding the first video signal of frame N, the luminance value of the sub-pixel 1 on which the mask filter 11F for making light pass through 100% of the area of the sub-pixel 1 is mounted is SB11, the luminance value of the sub-pixel 2 on which the mask filter 12F for making light pass through 50% of the area of the sub-pixel 2 is mounted is SB12, and the luminance value of the sub-pixel 3 on which the mask filter 13F for making light pass through 25% of the area of the sub-pixel 3 is mounted is SB13, and that regarding the second video signal of frame N, the luminance value of the sub-pixel 1 on which the mask filter 11F for making light pass through 100% of the area of the sub-pixel 1 is mounted is SB21, the luminance value of the sub-pixel 2 on which the mask filter 12F for making light pass through 50% of the area of the sub-pixel 2 is mounted is SB22, and the luminance value of the sub-pixel 3 on which the mask filter 13F for making light pass through 25% of the area of the sub-pixel 3 is mounted is SB23, then the summed luminance value Y of one pixel is obtained from the following equation (3).

$$Y=SB11+SB12+SB13+SB21+SB22+SB23 \quad (3)$$

The summed luminance value Y monotonically increases as shown in the following Table 6 with the luminance value 0.25 of the sub-pixel 3 as the least unit, and luminance values of 3571 stages can be obtained. Further, the Table 6 becomes identical with the Table 5.

TABLE 6

| No. | SB11 | SB12 | SB13 | SB21 | SB22 | SB23 | Y |
|---|---|---|---|---|---|---|---|
| 1 | 0 | 0 | 0 | 0 | 0 | 0 | 0.00 |
| 2 | 0 | 0 | 0 | 0 | 0 | 1 | 0.25 |
| 3 | 0 | 0 | 1 | 0 | 0 | 1 | 0.50 |
| 4 | 0 | 0 | 1 | 0 | 1 | 0 | 0.75 |
| 5 | 0 | 0 | 1 | 0 | 1 | 1 | 1.00 |
| 6 | 0 | 1 | 0 | 0 | 1 | 1 | 1.25 |
| 7 | 0 | 1 | 1 | 0 | 1 | 1 | 1.50 |
| 8 | 0 | 1 | 1 | 1 | 0 | 0 | 1.75 |
| . | . | . | . | . | . | . | . |
| . | . | . | . | . | . | . | . |
| . | . | . | . | . | . | . | . |
| 3570 | 255 | 255 | 255 | 255 | 255 | 254 | 892.250 |
| 3571 | 255 | 255 | 255 | 255 | 255 | 255 | 892.500 |

Thus, there is provided a two-dimensional monochrome liquid crystal display having its luminance resolution of 3571 stages. As discussed above, the liquid crystal display of the fourth embodiment has not only its luminance resolution of about twice that of the third embodiment but also advantages that a moving picture can be reproduced, the liquid crystal display of the fourth embodiment can easily be manufactured, and so on, as in the third embodiment. Further, there are a plurality of ways to select the luminance values of 3571 stages, as in the first embodiment.

In the third and the fourth embodiments, though on one of the three sub-pixels is mounted a mask filter for making light pass through 100% of the area of the one sub-pixel, to mount the mask filter having light transmittance of 100% on one sub-pixel is equivalent to that no mask filter is mounted on one sub-pixel. Accordingly, the same result may be obtained even in case no mask filter is mounted on one sub-pixel, a mask filter having light transmittance of 50% is mounted on one of the remaining two sub-pixels, and a mask filter having light transmittance of 25% is mounted on the other of the remaining two sub-pixels.

In addition, in the fourth embodiment, in case a video signal sent from a computer or the like is a still picture or still image, it is unnecessary to output a picture or image of the same frame two times, and hence a transmitted picture or image may be inputted directly to the first, second and third look-up table circuits LUT1, LUT2 and LUT3 without storing it in the frame memory 661. In this case, it is arranged that luminance of each of three sub-pixels 1, 2 and 3 constituting each pixel of Nth frame and (N+1)th frame is controlled by a control signal of, for example, 8 bits to display luminance of each pixel by the summed luminance value of both Nth and (N+1)th frames. Consequently, the frame memory 661 and the multiplexer 663 may be omitted. Moreover, if the function of the frame control circuit 662 is transferred to the LUT control circuit 63, the frame control circuit 662 also may be omitted. In other words, in case a video signal sent from a computer or the like is a still picture or still image, it is possible to make the luminance resolution of the liquid crystal display of the fourth embodiment high such as about twice that of the third embodiment or so even if the time base control circuit 66 is not provided.

Next, the fifth embodiment of the two-dimensional monochrome bit face display according to the present invention will be described in detail with reference to FIG. 5.

Figure 5:
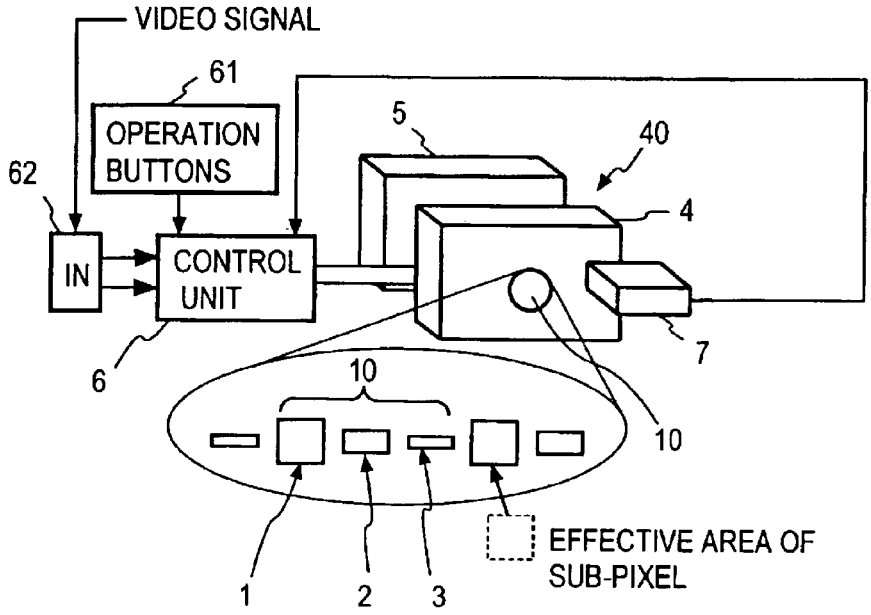
FIG. 5 is a diagrammatical view illustrating the fifth embodiment of the two-dimensional monochrome bit face display according to the present invention.

FIG. 5 is a diagrammatical view showing the fifth embodiment of the two-dimensional monochrome bit face display in which the present invention is applied to a liquid crystal display. As in the first embodiment, this display comprises: a liquid crystal display unit 40 including a liquid crystal display face (liquid crystal panel) 4 composed of a many number of pixels, and a backlight 5; a control unit 6 that controls luminance or intensity of each of the pixels of the liquid crystal panel 4; operation buttons 61 for inputting a various kinds of commands into the control unit 6; an input circuit (IN) 62 that receives a video or picture or image signal (hereinafter, referred to simply as video signal) and a control command transmitted from the outside; and a luminance measurement unit 7 that measures luminance or brightness of the top surface of the liquid crystal panel 4 and inputs the measured luminance into the control unit 6.

The display of the fifth embodiment also adopts the space modulation dither method discussed above, and hence, as shown in explanatory diagram in FIG. 5, one pixel 10 is constituted by three sub-pixels 1, 2 and 3. In this embodiment, it is arranged that areas (effective areas) of the three sub-pixels constituting each of the pixels of the liquid crystal panel 4 are made different so that the quantity of light (luminous energy) passing through each of the three sub-pixels differs from one another. For example, as shown in FIG. 5, the sub-pixel 1 of each pixel is manufactured to have the same area as that of an normal sub-pixel, the sub-pixel 2 of each pixel is manufactured to have its area equal to 50% of the area of the sub-pixel 1, and the sub-pixel 3 of each pixel is manufactured to have its area equal to 25% of the area of the sub-pixel 1. By manufacturing the three sub-pixels 1, 2 and 3 to have their areas in the proportion of 1:0.5:0.25, if the quantity of light passing through the sub-pixel 1 is 100%, the quantity of light passing through the sub-pixel 2 becomes 50%, and the quantity of light passing through the sub-pixel 3 becomes 25%.

The control unit 6 is not shown since a control unit having the same construction as that of the first embodiment discussed before may be used as the control unit 6. In addition, the control operations of the control unit 6 are the same as that of the first embodiment, and the explanation thereof will be omitted.

In the liquid crystal display of this fifth embodiment, if respective luminances of the three sub-pixels 1, 2 and 3 constituting each pixel are electronically controlled over 256 stages of gradation extending from 0 to 255 stages in accordance with control signals each being of 8 bits, as in the first or third embodiment, the luminance resolution of one pixel becomes 1786 stages of gradation as shown in the Table 3 already described, and hence it is possible to make the luminance resolution of the liquid crystal display high up to 1786 stages of gradation. In addition, since only the space modulation dither method is adopted, any problem of flicker does not occur and hence a moving picture can be reproduced. Furthermore, control circuits commonly used in a conventional color liquid crystal display can be utilized almost as they are as the control circuits for the liquid crystal display unit. Accordingly, there is also obtained an advantage that the liquid crystal display of the fifth embodiment can easily be manufactured.

In the fifth embodiment, as in the second embodiment, it may be arranged that the luminances of the three sub-pixels 1, 2 and 3 constituting one pixel are very minutely shifted in the direction of time base to convert a picture or image of every other frame into a picture or image consisting of two frames, and the luminance of one pixel is displayed by the summed luminance value obtained from addition of the luminance of a pixel of one of the two frames and the luminance of the corresponding pixel of the other of the two frames. According to such arrangement, it is possible to make the luminance resolution of the liquid crystal display high up to 3571 stages of gradation as in the second or fourth embodiment. As the control unit 6, a control unit having the construction shown in FIG. 2B may be used.

In the first, second, third, fourth and fifth embodiments discussed above, the present invention has been applied to the liquid crystal display in which each of the pixels of the liquid crystal panel 4 is constituted by three sub-pixels. This means that such liquid crystal display can easily be manufactured by merely altering or modifying the liquid crystal display unit and the control circuits therefor of a generally used color liquid crystal display to some extent. It is needless to say that each of the pixels of the liquid crystal panel 4 may be constituted by four or more sub-pixels. In such case, if the number of sub-pixels constituting one pixel is m (where m is an integer equal to or greater than 3), the quantity of light passing through the m sub-pixels is set to values that values of respective terms of a power series of $1/2^n$ (where n is an integer from 0 to m−1) are represented by percentage. For example, in case one pixel is constituted by four sub-pixels, the quantity of light is set in the proportion that the quantity of light passing through the first sub-pixel is 100%, the quantity of light passing through the second sub-pixel is 50%, the quantity of light passing through the third sub-pixel is 25%, and the quantity of light passing through the fourth sub-pixel is 12.5%. There is no necessity for setting these values of the quantity of light to exactly 100%, 50%, 25% and 12.5%, and they may be set to approximate values of 100%, 50%, 25% and 12.5%.

In addition, in the first, second, third, fourth and fifth embodiments discussed above, the quantity of light passing through three or more sub-pixels that constitute one pixel has been set to values that values of respective terms of a power series of $1/2^n$ are represented by percentage, or to approximate values of such values, it is to be noted that the quantity of light passing through three or more sub-pixels that constitute one pixel are not always set to values that values of respective terms of a power series of $1/2^n$ are represented by percentage, or to approximate values of such values.

Figure 6A:
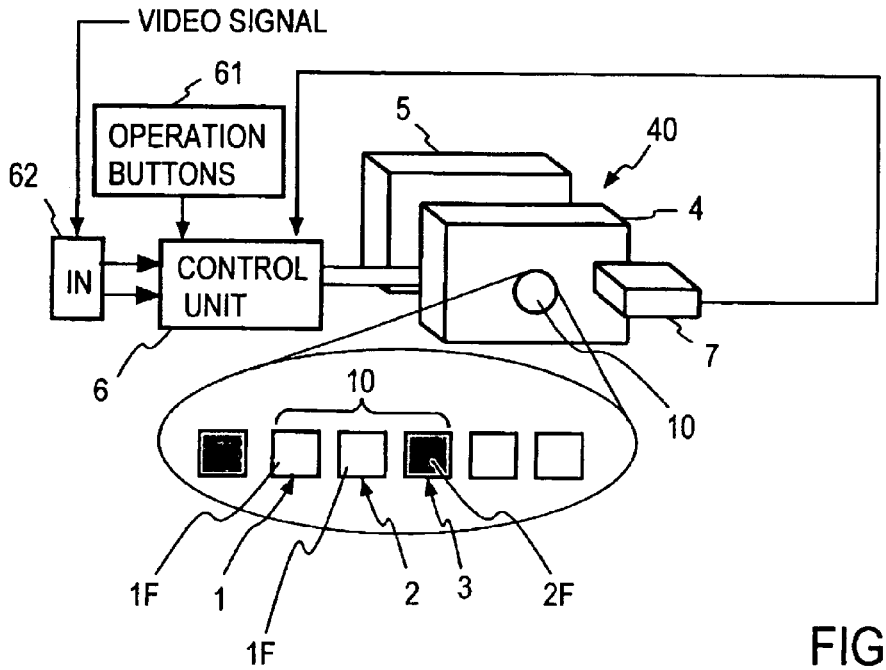
FIG. 6A is a diagrammatical view illustrating the sixth embodiment of the two-dimensional monochrome bit face display according to the present invention.
Figure 6B:
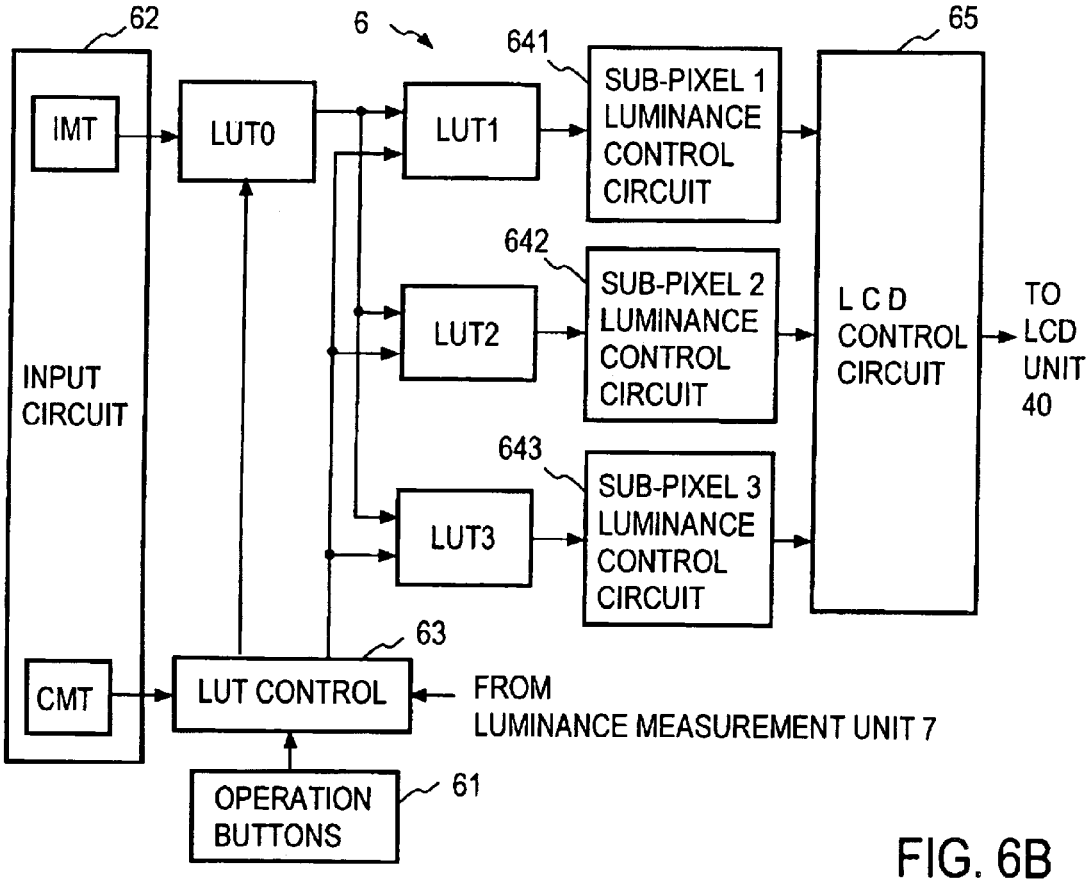
FIG. 6B is a block diagram showing one specified example of the control unit shown in FIG. 6A.

FIG. 6A is a diagrammatical view showing the sixth embodiment of the two-dimensional monochrome bit face display in which the present invention is applied to a liquid crystal display. As in the first embodiment, this display comprises: a liquid crystal display unit 40 including a liquid crystal display face (liquid crystal panel) 4 composed of a many number of pixels, and a backlight 5; a control unit 6 that controls luminance or intensity of each of the pixels of the liquid crystal panel 4; operation buttons 61 for inputting a various kinds of commands into the control unit 6; an input circuit (IN) 62 that receives a video or picture or image signal (hereinafter, referred to simply as video signal) and a control command transmitted from the outside; and a luminance measurement unit 7 that measures luminance or brightness of the top surface of the liquid crystal panel 4 and inputs the measured luminance into the control unit 6. FIG. 6B is a block diagram showing one specified example of the control unit 6 shown in FIG. 6A together with the operation buttons 61 and the input circuit 62.

The display of the sixth embodiment also adopts the space modulation dither method discussed above, and hence, as shown in explanatory diagram in FIG. 6A, one pixel 10 is constituted by three sub-pixels 1, 2 and 3. In this embodiment, on the three sub-pixels constituting each of the pixels of the liquid crystal panel 4 are mounted ND (neutral density) filters having different light transmittances (light transmission factors), respectively. For example, an ND filter 1F having its light transmittance of 100% is mounted on the sub-pixel 1 and the sub-pixel 2 of each pixel, and an ND filter 2F having its light transmittance of 50% is mounted on the sub-pixel 3 of each pixel.

A work or operation for mounting the above-mentioned ND filters on the sub-pixels of each of all pixels of the liquid crystal panel 4 respectively is easy because in a well known and conventionally used color liquid crystal display, instead of forming the R, G and B filters, the ND filters of 100%, 100% and 50% may be formed. Therefore, there occurs no problem in manufacture of the liquid crystal panel 4.

The control unit 6 has the same construction as that of the first embodiment discussed before as shown in FIG. 6B, and hence portions and elements or components in FIG. 6B corresponding to those in FIG. 1B will be denoted by the same reference characters attached thereto, and the operations and explanation thereof will be omitted.

In the sixth embodiment, if respective luminances of the three sub-pixels 1, 2 and 3 constituting each pixel are controlled over 256 stages of gradation in accordance with control signals each being of 8 bits, the luminance resolution of one pixel becomes 1276 stages of gradation as shown in the following Table 7, and hence it is possible to make the luminance resolution of the liquid crystal display high up to 1276 stages of gradation.

Explaining concretely, in the liquid crystal display of the sixth embodiment, in case respective luminances of the three sub-pixels 1, 2 and 3 constituting each pixel are electronically controlled over 256 stages of gradation extending from 0 to 255 stages in accordance with control signals each being of 8 bits, if the luminance value of the sub-pixel 1 on which the ND filter 1F having its light transmittance of 100% is mounted is SB1, the luminance value of the sub-pixel 2 on which the ND filter 1F having its light transmittance of 100% is mounted is SB2, and the luminance value of the sub-pixel 3 on which the ND filter 2F having its light transmittance of 50% is mounted is SB3, the summed luminance value Y of one pixel is obtained from the following equation (4).

$$Y=SB1+SB2+SB3 \tag{4}$$

The summed luminance value Y monotonically increases as shown in the following Table 7 with the luminance value 0.5 of the sub-pixel 3 as the least unit, and luminance values of 1276 stages can be obtained.

TABLE 7

| No. | Y | SB1 | SB2 | SB3 |
|---|---|---|---|---|
| 1 | 0.0 | 0 | 0 | 0 |
| 2 | 0.5 | 0 | 0 | 1 |
| 3 | 1.0 | 0 | 1 | 0 |
| 4 | 1.5 | 0 | 1 | 1 |
| 5 | 2.0 | 1 | 1 | 0 |
| 6 | 2.5 | 1 | 1 | 1 |
| 7 | 3.0 | 1 | 1 | 2 |
| 8 | 3.5 | 1 | 2 | 1 |
| . | . | . | . | . |
| . | . | . | . | . |
| . | . | . | . | . |
| 1275 | 637.0 | 255 | 255 | 254 |
| 1276 | 637.5 | 255 | 255 | 255 |

Further, there are a plurality of ways to select the luminance values of 1276 stages, and the following way of increasing the luminance values, for example, as shown in the following Table 8 may be taken.

TABLE 8

| No. | Y | SB1 | SB2 | SB3 |
|---|---|---|---|---|
| 1 | 0.0 | 0 | 0 | 0 |
| 2 | 0.5 | 0 | 0 | 1 |
| 3 | 1.0 | 0 | 0 | 2 |
| 4 | 1.5 | 0 | 0 | 3 |
| 5 | 2.0 | 0 | 0 | 4 |
| 6 | 2.5 | 0 | 0 | 5 |
| 7 | 3.0 | 0 | 0 | 6 |
| 8 | 3.5 | 0 | 0 | 7 |
| . | . | . | . | . |
| . | . | . | . | . |
| . | . | . | . | . |
| 1275 | 637.0 | 255 | 255 | 254 |
| 1276 | 637.5 | 255 | 255 | 255 |

Thus, there is provided a two-dimensional monochrome liquid crystal display having its luminance resolution of 1276 stages. In addition, since only the space modulation dither method is adopted, any problem of flicker does not occur and hence a moving picture can be produced. Furthermore, the liquid crystal display unit can be manufactured by substituting the ND filters for the R, G and B filters of the liquid crystal display unit in which each of the pixels is constituted by three sub-pixels developed in a color liquid crystal display as well as control circuits commonly used in a conventional color liquid crystal display can be utilized almost as they are as the control circuits for the liquid crystal display unit. Accordingly, there is also obtained an advantage that the liquid crystal display of the sixth embodiment can easily be manufactured.

Next, the seventh embodiment of the two-dimensional monochrome bit face display according to the present invention will be described in detail with reference to FIG. 7. This seventh embodiment is one in which the present invention is also applied to a liquid crystal display. However, the seventh embodiment is arranged such that the luminances of the three sub-pixels 1, 2 and 3 constituting one pixel in the sixth embodiment are very minutely shifted in the direction of time base to convert a picture or image of every other frame into a picture or image consisting of two frames and the luminance of one pixel is displayed by the summed luminance value obtained from addition of the luminance of a pixel of one of the two frames and the luminance of the corresponding pixel of the other of the two frames. This results in a further improvement in the luminance resolution of the liquid crystal display.

Figure 7A:
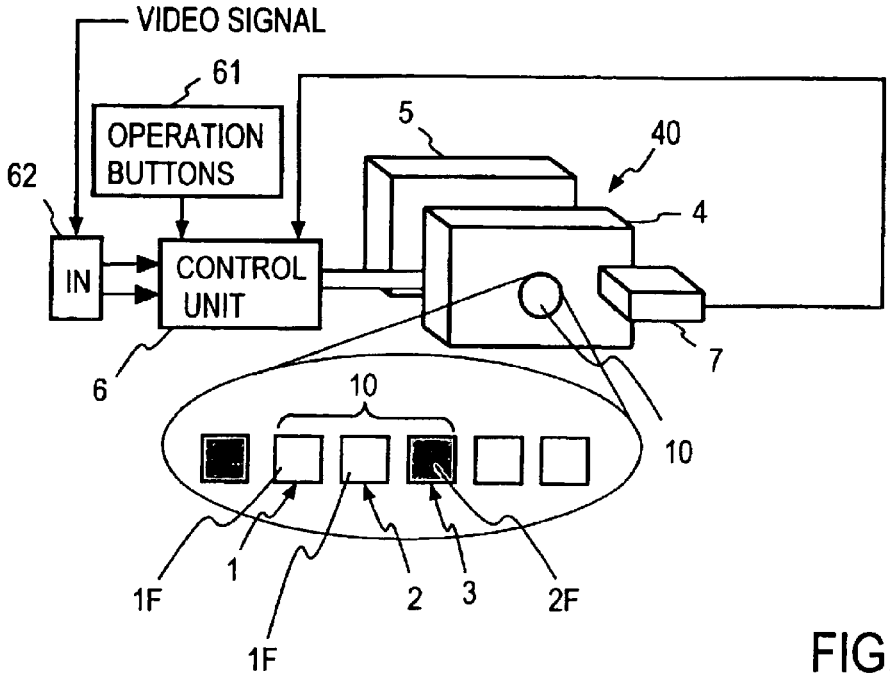
FIG. 7A is a diagrammatical view illustrating the seventh embodiment of the two-dimensional monochrome bit face display according to the present invention.
Figure 7B:
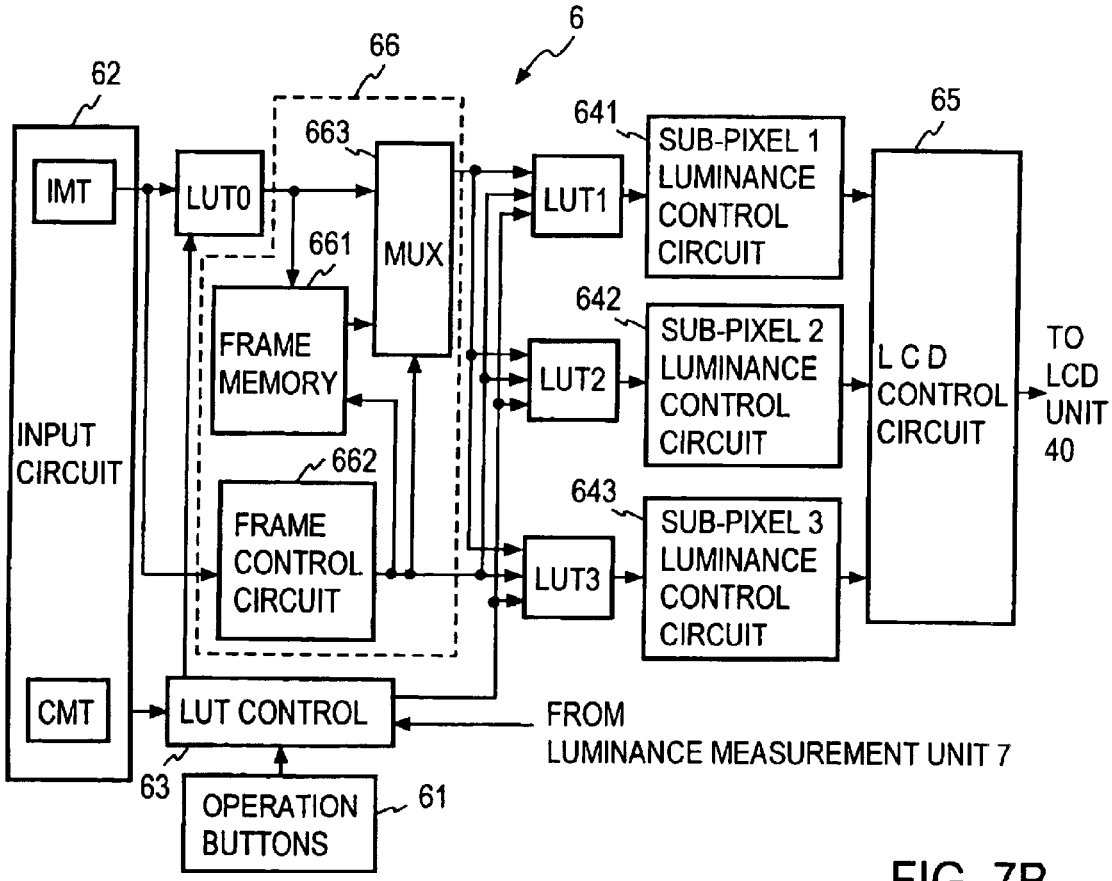
FIG. 7B is a block diagram showing one specified example of the control unit shown in FIG. 7A.

As shown in FIG. 7A, the seventh embodiment of the liquid crystal display has the same diagrammatical construction as that of the sixth embodiment discussed above. However, as shown in FIG. 7B, in the display of the seventh embodiment, the control unit 6 further includes a time base control circuit 66 added thereto which comprises a frame memory 661, a frame control circuit 662 and a multiplexer (MUX) 663. The circuit construction of this control unit 6 is the same as that of the second embodiment, and portions and elements or components in FIG. 7B corresponding to those in FIG. 2B will be denoted by the same reference characters attached thereto, and the operations and explanation thereof will be omitted.

In the seventh embodiment, too, in accordance with the control of the frame control circuit 662, the two luminance control signals each having 8 bits based on two video signals one being the first video signal of frame N and the other being the second video signal of frame N are supplied in regular sequence to the liquid crystal display unit 40 through the liquid crystal display control circuit 65, and so two video signals of the same Nth frame are displayed in regular sequence on the liquid crystal panel 4 of the liquid crystal display unit 40. Accordingly, if luminance of each of three sub-pixels 1, 2 and 3 constituting each pixel is controlled by a control signal of 8 bits over 256 stages of gradation, luminance control of 1276 stages of gradation as to the first video signal of frame N and luminance control of 1276 stages of gradation as to the second video signal of frame N can be done, and so the luminance control of 2552 stages of gradation in total (in reality, up to 2551 stages of gradation since two of the luminance value 0 are unified to one) can be done.

Explaining concretely, in the liquid crystal display of the seventh embodiment, in case luminance of each of three sub-pixels 1, 2 and 3 constituting each pixel is electronically controlled by the control signal of 8 bits over 256 stages of gradation extending from 0 to 255 stages, assuming that regarding the first video signal of frame N, the luminance value of the sub-pixel 1 on which the ND filter 1F having its light transmittance of 100% is mounted is SB11, the luminance value of the sub-pixel 2 on which the ND filter 1F having its light transmittance of 100% is mounted is SB12, and the luminance value of the sub-pixel 3 on which the ND filter 2F having its light transmittance of 50% is mounted is SB13, and that regarding the second video signal of frame N, the luminance value of the sub-pixel 1 on which the ND filter 1F having its light transmittance of 100% is mounted is SB21, the luminance value of the sub-pixel 2 on which the ND filter 1F having its light transmittance of 100% is mounted is SB22, and the luminance value of the sub-pixel 3 on which the ND filter 2F having its light transmittance of 50% is mounted is SB23, then the summed luminance value Y of one pixel is obtained from the following equation (5).

$$Y=SB11+SB12+SB13+SB21+SB22+SB23 \quad (5)$$

The summed luminance value Y monotonically increases as shown in the following Table 9 with the luminance value 0.5 of the sub-pixel 3 as the least unit, and luminance values of 2551 stages can be obtained.

TABLE 9

| No. | SB11 | SB12 | SB13 | SB21 | SB22 | SB23 | Y |
|---|---|---|---|---|---|---|---|
| 1 | 0 | 0 | 0 | 0 | 0 | 0 | 0.0 |
| 2 | 0 | 0 | 0 | 0 | 0 | 1 | 0.5 |
| 3 | 0 | 0 | 1 | 0 | 0 | 1 | 1.0 |
| 4 | 0 | 0 | 1 | 0 | 1 | 0 | 1.5 |
| 5 | 0 | 0 | 1 | 0 | 1 | 1 | 2.0 |
| 6 | 0 | 1 | 0 | 0 | 1 | 1 | 2.5 |
| 7 | 0 | 1 | 1 | 0 | 1 | 1 | 3.0 |
| 8 | 0 | 1 | 1 | 1 | 1 | 0 | 3.5 |
| . | . | . | . | . | . | . | . |
| . | . | . | . | . | . | . | . |
| . | . | . | . | . | . | . | . |
| 2550 | 255 | 255 | 255 | 255 | 255 | 254 | 1274.5 |
| 2551 | 255 | 255 | 255 | 255 | 255 | 255 | 1275.0 |

Thus, there is provided a two-dimensional monochrome liquid crystal display having its luminance resolution of 2551 stages. As discussed above, the liquid crystal display of the seventh embodiment has not only its luminance resolution of about twice that of the sixth embodiment but also advantages that a moving picture can be reproduced, the liquid crystal display of the seventh embodiment can easily be manufactured, and so on, as in the sixth embodiment. Further, there are a plurality of ways to select the luminance values of 2551 stages, as in the sixth embodiment.

In the sixth and the seventh embodiments, though an ND filter having light transmittance of 100% is mounted on two of the three sub-pixels, to mount the ND filter having light transmittance of 100% on two sub-pixels is equivalent to that no ND filter is mounted on two sub-pixels. Accordingly, the same result may be obtained even in case no ND filter is mounted on two sub-pixels, and an ND filter having light transmittance of 50% is mounted on the remaining one sub-pixel.

In addition, in the seventh embodiment, in case a video signal sent from a computer or the like is a still picture or still image, it is unnecessary to output a picture or image of the same frame two times, and hence a transmitted picture or image may be inputted directly to the first, second and third look-up table circuits LUT1, LUT2 and LUT3 without storing it in the frame memory 661. In this case, it is arranged that luminance of each of three sub-pixels 1, 2 and 3 constituting each pixel of Nth frame and (N+1)th frame is controlled by a control signal of, for example, 8 bits to display luminance of each pixel by the summed luminance value of both Nth and (N+1)th frames. Consequently, the frame memory 661 and the multiplexer 663 may be omitted. Moreover, if the function of the frame control circuit 662 is transferred to the LUT control circuit 63, the frame control circuit 662 also may be omitted. In other words, in case a video signal sent from a computer or the like is a still picture or still image, it is possible to make the luminance resolution of the liquid crystal display of the seventh embodiment high such as about twice that of the sixth embodiment or so even if the time base control circuit 66 is not provided.

Next, the eighth embodiment of the two-dimensional monochrome bit face display according to the present invention will be described in detail with reference to FIG. 8.

Figure 8A:
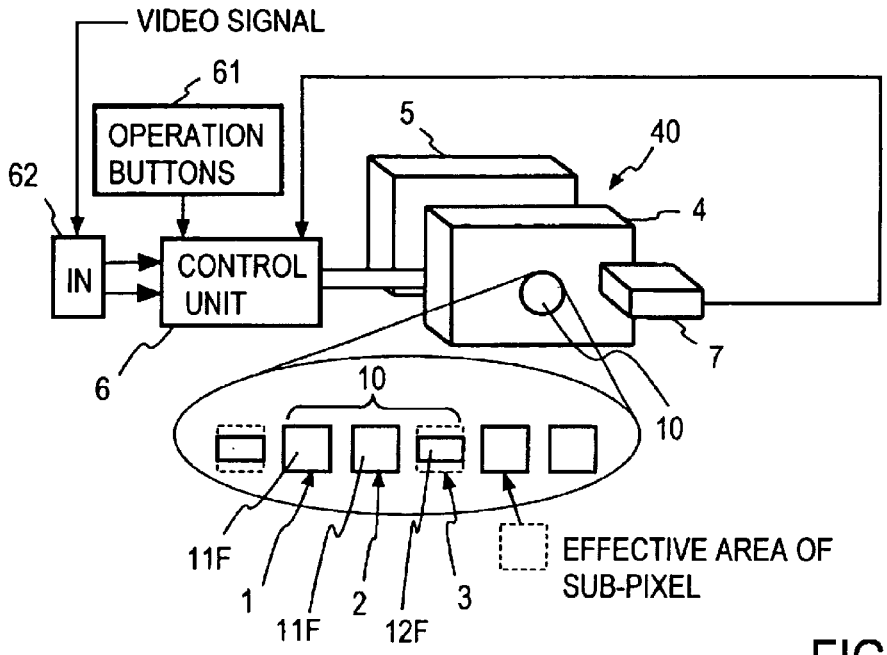
FIG. 8A is a diagrammatical view illustrating the eighth embodiment of the two-dimensional monochrome bit face display according to the present invention.
Figure 8B:
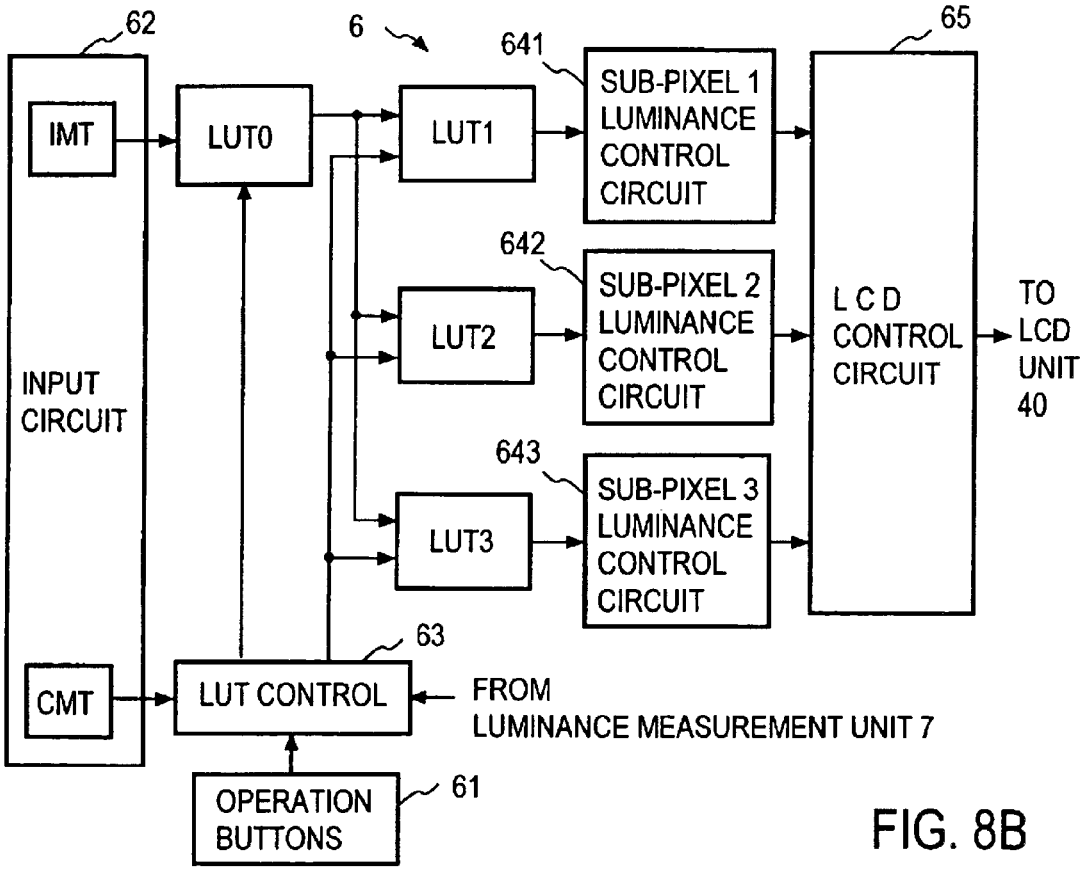
FIG. 8B is a block diagram showing one specified example of the control unit shown in FIG. 8A.

FIG. 8A is a diagrammatical view showing the eighth embodiment of the two-dimensional monochrome bit face display in which the present invention is applied to a liquid crystal display. As in the first embodiment, this display comprises: a liquid crystal display unit 40 including a liquid crystal display face (liquid crystal panel) 4 composed of a many number of pixels, and a backlight 5; a control unit 6 that controls luminance or intensity of each of the pixels of the liquid crystal panel 4; operation buttons 61 for inputting a various kinds of commands into the control unit 6; an input circuit (IN) 62 that receives a video or picture or image signal (hereinafter, referred to simply as video signal) and a control command transmitted from the outside; and a luminance measurement unit 7 that measures luminance or brightness of the top surface of the liquid crystal panel 4 and inputs the measured luminance into the control unit 6. FIG. 8B is a block diagram showing one specified example of the control unit 6 shown in FIG. 8A together with the operation buttons 61 and the input circuit 62.

The display of the eighth embodiment, too, adopts the space modulation dither method discussed above, and hence, as shown in explanatory diagram in FIG. 8A, one pixel 10 is constituted by three sub-pixels 1, 2 and 3. In this embodiment, on the three sub-pixels constituting each of the pixels of the liquid crystal panel 4 are mounted mask filters having windows or openings of different sizes for making areas of sub-pixels through which light passes different, respectively. Hereinafter, such filters will be referred to simply as mask filters. For example, as shown in FIG. 8A, on the sub-pixel 1 of each pixel is mounted a mask filter 11F for making light pass through all over the area of the sub-pixel 1, that is, for making light pass through 100% of the area of the sub-pixel 1, on the sub-pixel 2 of each pixel is mounted also a mask filter 11F for making light pass through 100% of the area of the sub-pixel 2, and on the sub-pixel 3 of each pixel is mounted a mask filter 12F for making light pass through 50% of the area of the sub-pixel 3. In other words, the mask filter 11F has its window the size of which is equal to the effective area of each of the sub-pixels 1 and 2, and the mask filter 12F has its window the size of which is equal to a half of the effective area of the sub-pixel 3.

A work or operation for mounting the above-mentioned mask filters on the sub-pixels of each of all pixels of the liquid crystal panel 4 respectively is easy because in a well known and conventionally used color liquid crystal display, instead of forming the R, G and B filters, the mask filters of 100%, 100% and 50% may be formed. Therefore, there occurs no problem in manufacture of the liquid crystal panel 4.

The control unit 6 has the same construction as that of the first embodiment discussed before as shown in FIG. 8B, and hence portions and elements or components in FIG. 8B corresponding to those in FIG. 1B will be denoted by the same reference characters attached thereto, and the operations and explanation thereof will be omitted.

In the liquid crystal display of the eighth embodiment, if respective luminances of the three sub-pixels 1, 2 and 3 constituting each pixel are electronically controlled over 256 stages of gradation extending from 0 to 255 stages in accordance with control signals each being of 8 bits, as in the sixth embodiment, from the equation (4), the summed luminance value Y of one pixel monotonically increases as shown in the Table 7 already described with the luminance value 0.5 of the sub-pixel 3 as the least unit, and luminance values of 1276 stages can be obtained. That is, the luminance resolution of one pixel becomes 1276 stages of gradation and hence it is possible to make the luminance resolution of the liquid crystal display high up to 1276 stages of gradation. In addition, since only the space modulation dither method is adopted, any problem of flicker does not occur and hence a moving picture can be reproduced. Furthermore, the liquid crystal display unit can be manufactured by substituting the mask filters for the R, G and B filters of the liquid crystal display unit in which each of the pixels is constituted by three sub-pixels developed in a color liquid crystal display as well as control circuits commonly used in a conventional color liquid crystal display can be utilized almost as they are as the control circuits for the liquid crystal display unit. Accordingly, there is also obtained an advantage that the liquid crystal display of the eighth embodiment can easily be manufactured.

Further, there are a plurality of ways to select the luminance values of 1276 stages as in the sixth embodiment, and the way of increasing the luminance values as shown in the Table 8 already described may be taken.

Next, the ninth embodiment of the two-dimensional monochrome bit face display according to the present invention will be described in detail with reference to FIG. 9. This ninth embodiment is one in which the present invention is also applied to a liquid crystal display. However, the ninth embodiment is arranged such that the luminances of the three sub-pixels 1, 2 and 3 constituting one pixel in the eighth embodiment are very minutely shifted in the direction of time base to convert a picture or image of every other frame into a picture or image consisting of two frames and the luminance of one pixel is displayed by the summed luminance value obtained from addition of the luminance of a pixel of one of the two frames and the luminance of the corresponding pixel of the other of the two frames. This results in a further improvement in the luminance resolution of the liquid crystal display.

Figure 9A:
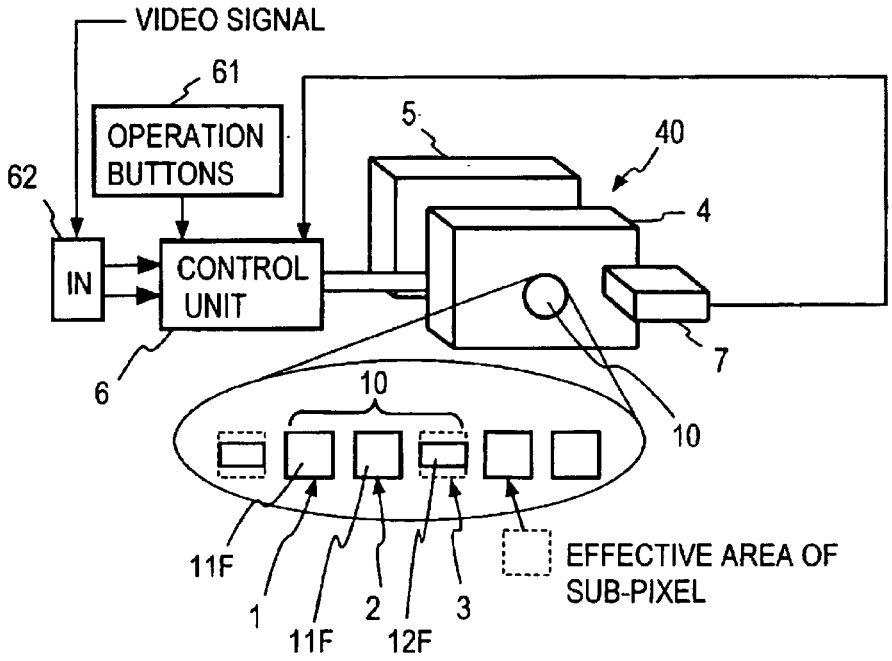
FIG. 9A is a diagrammatical view illustrating the ninth embodiment of the two-dimensional monochrome bit face display according to the present invention.
Figure 9B:
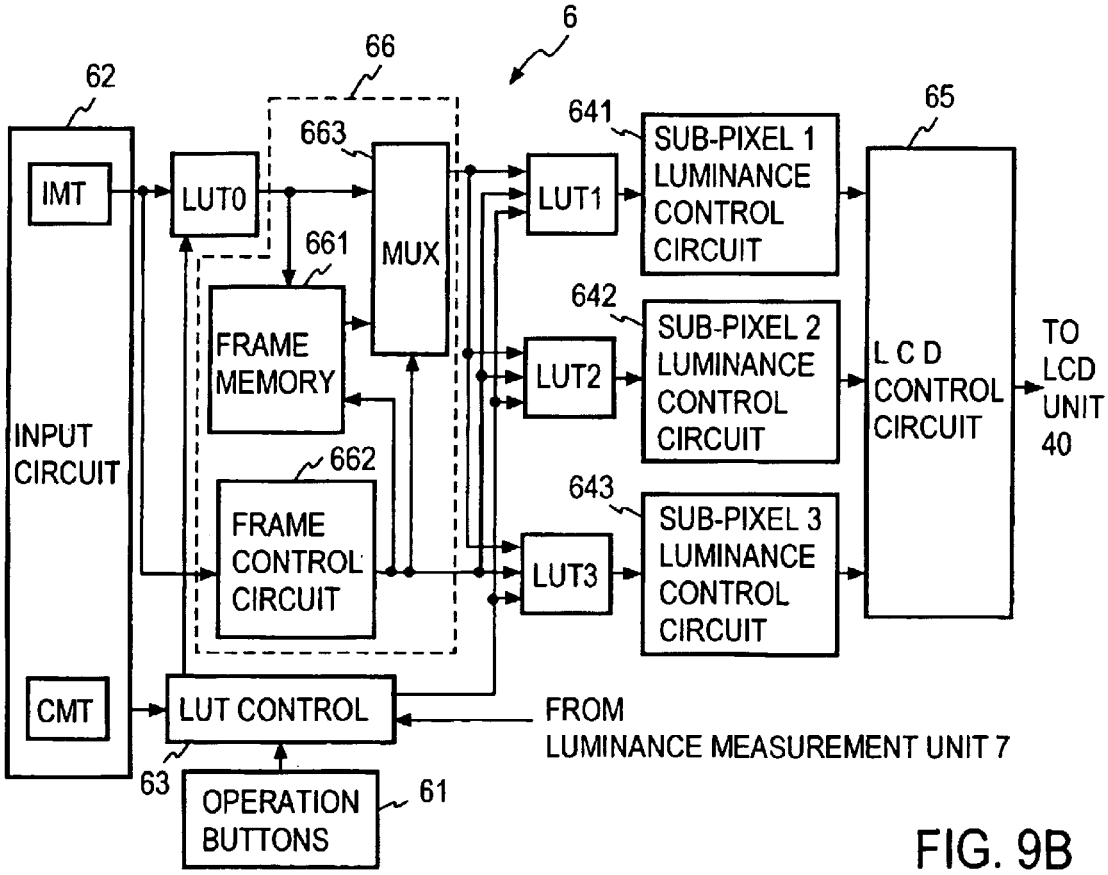
FIG. 9B is a block diagram showing one specified example of the control unit shown in FIG. 9A.

As shown in FIG. 9A, the ninth embodiment of the liquid crystal display has the same diagrammatical construction as that of the eighth embodiment discussed above. However, as shown in FIG. 9B, in the display of the ninth embodiment, the control unit 6 further includes a time base control circuit 66 added thereto which comprises a frame memory 661, a frame control circuit 662 and a multiplexer (MUX) 663. The circuit construction of this control unit 6 is the same as that of the second embodiment, and portions and elements or components in FIG. 9B corresponding to those in FIG. 2B will be denoted by the same reference characters attached thereto, and the operations and explanation thereof will be omitted.

In the ninth embodiment, too, in accordance with the control of the frame control circuit 662, the two luminance control signals each having 8 bits based on two video signals one being the first video signal of frame N and the other being the second video signal of frame N are supplied in regular sequence to the liquid crystal display unit 40 through the liquid crystal display control circuit 65, and so two video signals of the same Nth frame are displayed in regular sequence on the liquid crystal panel 4 of the liquid crystal display unit 40. Accordingly, if luminance of each of three sub-pixels 1, 2 and 3 constituting each pixel is electronically controlled by a control signal of 8 bits over 256 stages of gradation extending from 0 to 255 stages, luminance control of 1276 stages of gradation as to the first video signal of frame N and luminance control of 1276 stages of gradation as to the second video signal of frame N can be done, and so the luminance control of 2552 stages of gradation in total (in reality, up to 2551 stages of gradation since two of the luminance value 0 are unified to one) can be done. Thus, there is provided a two-dimensional monochrome liquid crystal display having its luminance resolution of 2551 stages.

Further, the summed luminance value Y of one pixel is obtained from the equation (5) described before. This summed luminance value Y monotonically increases as shown in the Table 9 already described with the luminance value 0.5 of the sub-pixel 3 as the least unit, and luminance values of 2551 stages can be obtained. In addition, there are a plurality of ways to select the luminance values of 2551 stages, as in the sixth embodiment.

As discussed above, the liquid crystal display of the ninth embodiment has not only its luminance resolution of about twice that of the eighth embodiment but also advantages that a moving picture can be reproduced, the liquid crystal display of the ninth embodiment can easily be manufactured, and so on, as in the eighth embodiment.

In the eighth and the ninth embodiments, though on two of the three sub-pixels is mounted a mask filter for making light pass through 100% of the area of each of the two sub-pixels, to mount the mask filter having light transmittance of 100% on two sub-pixels is equivalent to that no mask filter is mounted on two sub-pixels. Accordingly, the same result may be obtained even in case no mask filter is mounted on two sub-pixels, and a mask filter having light transmittance of 50% is mounted on the remaining one sub-pixel.

In addition, in the ninth embodiment, in case a video signal sent from a computer or the like is a still picture or still image, it is unnecessary to output a picture or image of the same frame two times, and hence a transmitted picture or image may be inputted directly to the first, second and third look-up table circuits LUT1, LUT2 and LUT3 without storing it in the frame memory 661. In this case, it is arranged that luminance of each of three sub-pixels 1, 2 and 3 constituting each pixel of Nth frame and (N+1)th frame is controlled by a control signal of, for example, 8 bits to display luminance of each pixel by the summed luminance value of both Nth and (N+1)th frames. Consequently, the frame memory 661 and the multiplexer 663 may be omitted. Moreover, if the function of the frame control circuit 662 is transferred to the LUT control circuit 63, the frame control circuit 662 also may be omitted. In other words, in case a video signal sent from a computer or the like is a still picture or still image, it is possible to make the luminance resolution of the liquid crystal display of the ninth embodiment high such as about twice that of the eighth embodiment or so even if the time base control circuit 66 is not provided.

Next, the tenth embodiment of the two-dimensional monochrome bit face display according to the present invention will be described in detail with reference to FIG. 10.

Figure 10:
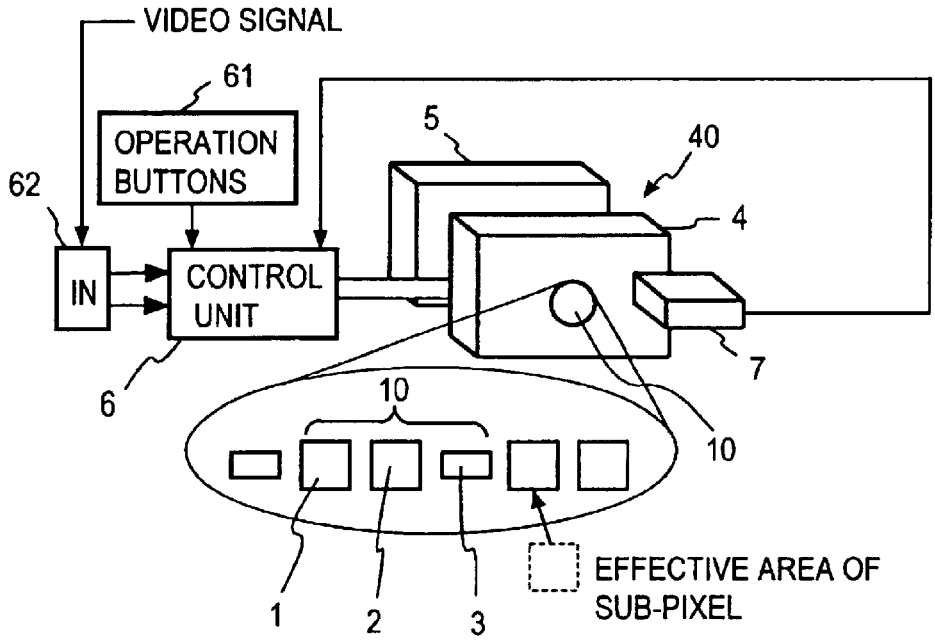
FIG. 10 is a diagrammatical view illustrating the tenth embodiment of the two-dimensional monochrome bit face display according to the present invention.

FIG. 10 is a diagrammatical view showing the tenth embodiment of the two-dimensional monochrome bit face display in which the present invention is applied to a liquid crystal display. As in the first embodiment, this display comprises: a liquid crystal display unit 40 including a liquid crystal display face (liquid crystal panel) 4 composed of a many number of pixels, and a backlight 5; a control unit 6 that controls luminance or intensity of each of the pixels of the liquid crystal panel 4; operation buttons 61 for inputting a various kinds of commands into the control unit 6; an input circuit (IN) 62 that receives a video or picture or image signal (hereinafter, referred to simply as video signal) and a control command transmitted from the outside; and a luminance measurement unit 7 that measures luminance or brightness of the top surface of the liquid crystal panel 4 and inputs the measured luminance into the control unit 6.

The display of this tenth embodiment, too, adopts the space modulation dither method discussed above, and hence, as shown in explanatory diagram in FIG. 10, one pixel 10 is constituted by three sub-pixels 1, 2 and 3. In this embodiment, it is arranged that areas of the three sub-pixels constituting each of the pixels of the liquid crystal panel 4 are made different so that the quantity of light (luminous energy) passing through each of the three sub-pixels differs from one another. For example, as shown in FIG. 10, the sub-pixels 1 and 2 of each pixel are manufactured to have the same area as that of an normal sub-pixel, and the sub-pixel 3 of each pixel is manufactured to have its area equal to 50% of the area of the sub-pixel 1. By manufacturing the three sub-pixels 1, 2 and 3 to have their areas in the proportion of 1:1:0.5, if the quantity of light passing through the sub-pixel 1 is 100%, the quantity of light passing through the sub-pixel 2 also becomes 100%, and the quantity of light passing through the sub-pixel 3 becomes 50%.

The control unit 6 is not shown since a control unit having the same construction as that of the first embodiment discussed before may be used as the control unit 6. In addition, the control operations of the control unit 6 are the same as that of the first embodiment, and the explanation thereof will be omitted.

In the liquid crystal display of the tenth embodiment, if respective luminances of the three sub-pixels 1, 2 and 3 constituting each pixel are electronically controlled over 256 stages of gradation extending from 0 to 255 stages in accordance with control signals each being of 8 bits, as in the sixth or the eighth embodiment, from the above equation (4), the luminance resolution of one pixel becomes 1276 stages of gradation as shown in the Table 7 already described, and hence it is possible to make the luminance resolution of the liquid crystal display high up to 1276 stages of gradation. In addition, since only the space modulation dither method is adopted, any problem of flicker does not occur and hence a moving picture can be reproduced. Furthermore, control circuits commonly used in a conventional color liquid crystal display can be utilized almost as they are as the control circuits for the liquid crystal display unit. Accordingly, there is also obtained an advantage that the liquid crystal display of the tenth embodiment can easily be manufactured.

In the liquid crystal display of the tenth embodiment, as in the second embodiment, it may be arranged that the luminances of the three sub-pixels 1, 2 and 3 constituting one pixel are very minutely shifted in the direction of time base to convert a picture or image of every other frame into a picture or image consisting of two frames, and the luminance of one pixel is displayed by the summed luminance value obtained from addition of the luminance of a pixel of one of the two frames and the luminance of the corresponding pixel of the other of the two frames. According to such arrangement, it is possible to make the luminance resolution of the liquid crystal display high up to 2551 stages of gradation as shown in the Table 9 already described. As the control unit 6, a control unit having the construction shown in FIG. 2B may be used. In addition, there are a plurality of ways to select the luminance values of 2551 stages, as in the sixth embodiment.

In the sixth, seventh, eighth, ninth, and tenth embodiments discussed above, since the quantity of light passing through three sub-pixels 1, 2 and 3 that constitute one pixel has been set to have the proportion of 100%:100%:50%, though the theoretical gradation of one pixel becomes 1276 stages of gradation or 2551 stages of gradation, the luminance thereof is none the less lowered merely to 250/300% even if a backlight that is the same as prior art one is used. Accordingly, it is sufficient to carry out a correction of 300/250% as to the luminance, and hence there is obtained a further advantage that the life time of the backlight is prolonged.

Figure 11A:
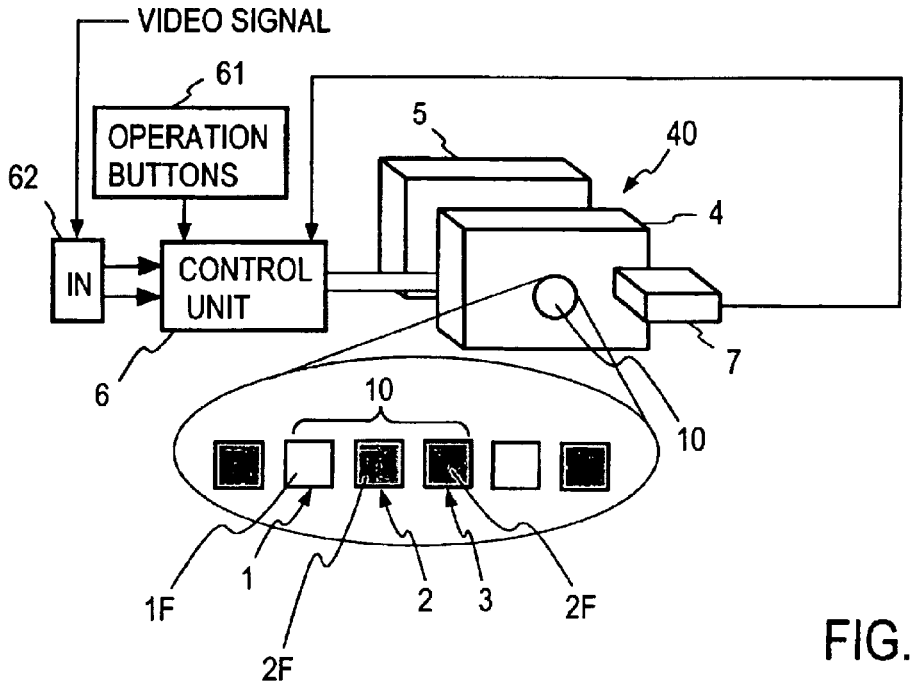
FIG. 11A is a diagrammatical view illustrating the eleventh embodiment of the two-dimensional monochrome bit face display according to the present invention.
Figure 11B:
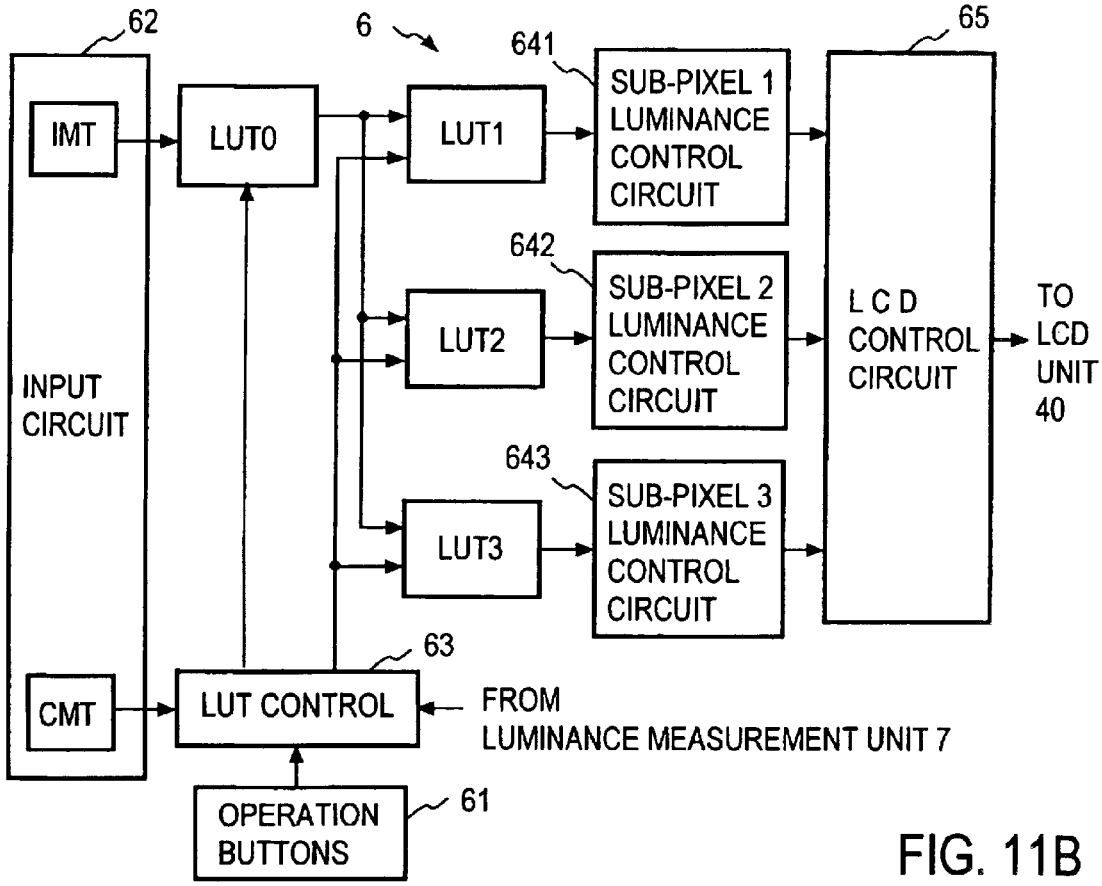
FIG. 11B is a block diagram showing one specified example of the control unit shown in FIG. 11A.

FIG. 11A is a diagrammatical view showing the eleventh embodiment of the two-dimensional monochrome bit face display in which the present invention is applied to a liquid crystal display. As in the first embodiment, this display comprises: a liquid crystal display unit 40 including a liquid crystal display face (liquid crystal panel) 4 composed of a many number of pixels, and a backlight 5; a control unit 6 that controls luminance or intensity of each of the pixels of the liquid crystal panel 4; operation buttons 61 for inputting a various kinds of commands into the control unit 6; an input circuit (IN) 62 that receives a video or picture or image signal (hereinafter, referred to simply as video signal) and a control command transmitted from the outside; and a luminance measurement unit 7 that measures luminance or brightness of the top surface of the liquid crystal panel 4 and inputs the measured luminance into the control unit 6. FIG. 11B is a block diagram showing one specified example of the control unit 6 shown in FIG. 11A together with the operation buttons 61 and the input circuit 62.

The display of the eleventh embodiment also adopts the space modulation dither method discussed above, and hence, as shown in explanatory diagram in FIG. 11A, one pixel 10 is constituted by three sub-pixels 1, 2 and 3. In this embodiment, on the three sub-pixels constituting each of the pixels of the liquid crystal panel 4 are mounted ND (neutral density) filters having different light transmittances (light transmission factors), respectively. For example, an ND filter 1F having its light transmittance of 100% is mounted on the sub-pixel 1 of each pixel, and an ND filter 2F having its light transmittance of 50% is mounted on the sub-pixels 2 and 3 of each pixel.

A work or operation for mounting the above-mentioned ND filters on the sub-pixels of each of all pixels of the liquid crystal panel 4 respectively is easy because in a well known and conventionally used color liquid crystal display, instead of forming the R, G and B filters, the ND filters of 100%, 50% and 50% may be formed.

Therefore, there occurs no problem in manufacture of the liquid crystal panel 4.

The control unit 6 has the same construction as that of the first embodiment discussed before as shown in FIG. 11B, and hence portions and elements or components in FIG. 11B corresponding to those in FIG. 1B will be denoted by the same reference characters attached thereto, and the operations and explanation thereof will be omitted.

In the eleventh embodiment, if respective luminances of the three sub-pixels 1, 2 and 3 constituting each pixel are controlled over 256 stages of gradation in accordance with control signals each being of 8 bits, the luminance resolution of one pixel becomes 1021 stages of gradation as shown in the following Table 10, and hence it is possible to make the luminance resolution of the liquid crystal display high up to 1021 stages of gradation.

Explaining concretely, in the liquid crystal display of the eleventh embodiment, in case respective luminances of the three sub-pixels 1, 2 and 3 constituting each pixel are electronically controlled over 256 stages of gradation extending from 0 to 255 stages in accordance with control signals each being of 8 bits, if the luminance value of the sub-pixel 1 on which the ND filter 1F having its light transmittance of 100% is mounted is SB1, the luminance value of the sub-pixel 2 on which the ND filter 2F having its light transmittance of 50% is mounted is SB2, and the luminance value of the sub-pixel 3 on which the ND filter 2F having its light transmittance of 50% is mounted is SB3, the summed luminance value Y of one pixel is obtained from the following equation (6).

$$Y=SB1+SB2+SB3 \tag{6}$$

The summed luminance value Y monotonically increases as shown in the following Table 10 with the luminance value 0.5 of the sub-pixel 3 as the least unit, and luminance values of 1021 stages can be obtained.

TABLE 10

| No. | Y | SB1 | SB2 | SB3 |
|---|---|---|---|---|
| 1 | 0.0 | 0 | 0 | 0 |
| 2 | 0.5 | 0 | 0 | 1 |
| 3 | 1.0 | 0 | 1 | 1 |
| 4 | 1.5 | 1 | 0 | 1 |
| 5 | 2.0 | 1 | 1 | 1 |
| 6 | 2.5 | 1 | 1 | 2 |
| 7 | 3.0 | 1 | 2 | 2 |
| 8 | 3.5 | 2 | 1 | 2 |
| . | . | . | . | . |
| . | . | . | . | . |
| . | . | . | . | . |
| 1020 | 509.5 | 255 | 255 | 254 |
| 1021 | 510.0 | 255 | 255 | 255 |

Further, there are a plurality of ways to select the luminance values of 1021 stages, and a way of increasing the luminance values, for example, as shown in the following Table 11 may be taken.

TABLE 11

| No. | Y | SB1 | SB2 | SB3 |
|---|---|---|---|---|
| 1 | 0.0 | 0 | 0 | 0 |
| 2 | 0.5 | 0 | 0 | 1 |
| 3 | 1.0 | 0 | 0 | 2 |
| 4 | 1.5 | 0 | 0 | 3 |
| 5 | 2.0 | 0 | 0 | 4 |
| 6 | 2.5 | 0 | 0 | 5 |
| 7 | 3.0 | 0 | 0 | 6 |
| 8 | 3.5 | 0 | 0 | 7 |
| . | . | . | . | . |
| . | . | . | . | . |
| . | . | . | . | . |
| 1020 | 509.5 | 255 | 255 | 254 |
| 1021 | 510.0 | 255 | 255 | 255 |

Thus, there is provided a two-dimensional monochrome liquid crystal display having its luminance resolution of 1021 stages. In addition, since only the space modulation dither method is adopted, any problem of flicker does not occur and hence a moving picture can be reproduced. Furthermore, the liquid crystal display unit can be manufactured by substituting the ND filters for the R, G and B filters of the liquid crystal display unit in which each of the pixels is constituted by three sub-pixels developed in a color liquid crystal display as well as control circuits commonly used in a conventional color liquid crystal display can be utilized almost as they are as the control circuits for the liquid crystal display unit. Accordingly, there is also obtained an advantage that the liquid crystal display of the eleventh embodiment can easily be manufactured.

Next, the twelfth embodiment of the two-dimensional monochrome bit face display according to the present invention will be described in detail with reference to FIG. 12. This twelfth embodiment is one in which the present invention is also applied to a liquid crystal display. However, the twelfth embodiment is arranged such that the luminances of the three sub-pixels 1, 2 and 3 constituting one pixel in the eleventh embodiment are very minutely shifted in the direction of time base to convert a picture or image of every other frame into a picture or image consisting of two frames and the luminance of one pixel is displayed by the summed luminance value obtained from addition of the luminance of a pixel of one of the two frames and the luminance of the corresponding pixel of the other of the two frames. This results in a further improvement in the luminance resolution of the liquid crystal display.

Figure 12A:
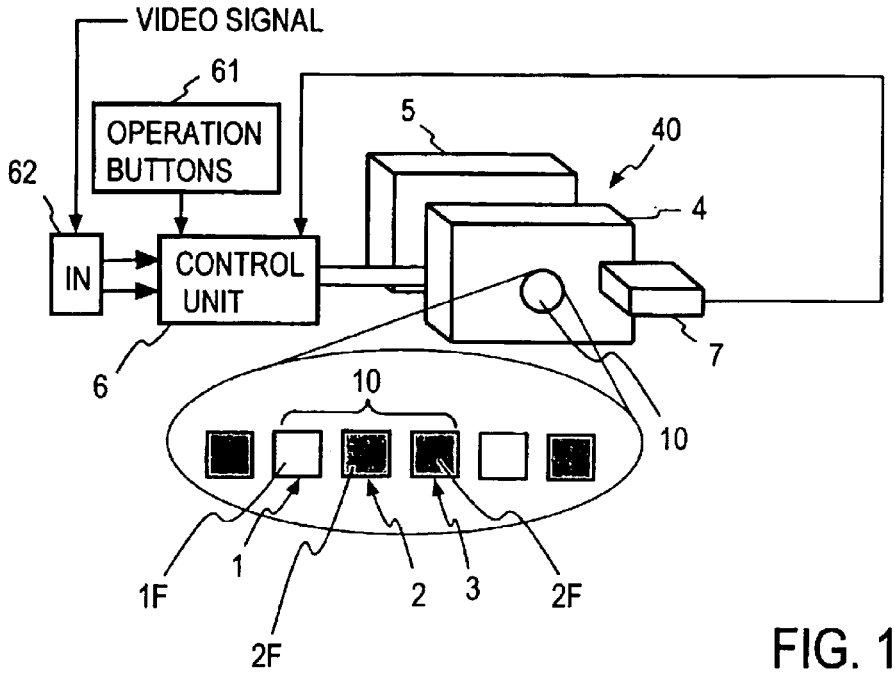
FIG. 12A is a diagrammatical view illustrating the twelfth embodiment of the two-dimensional monochrome bit face display according to the present invention.
Figure 12B:
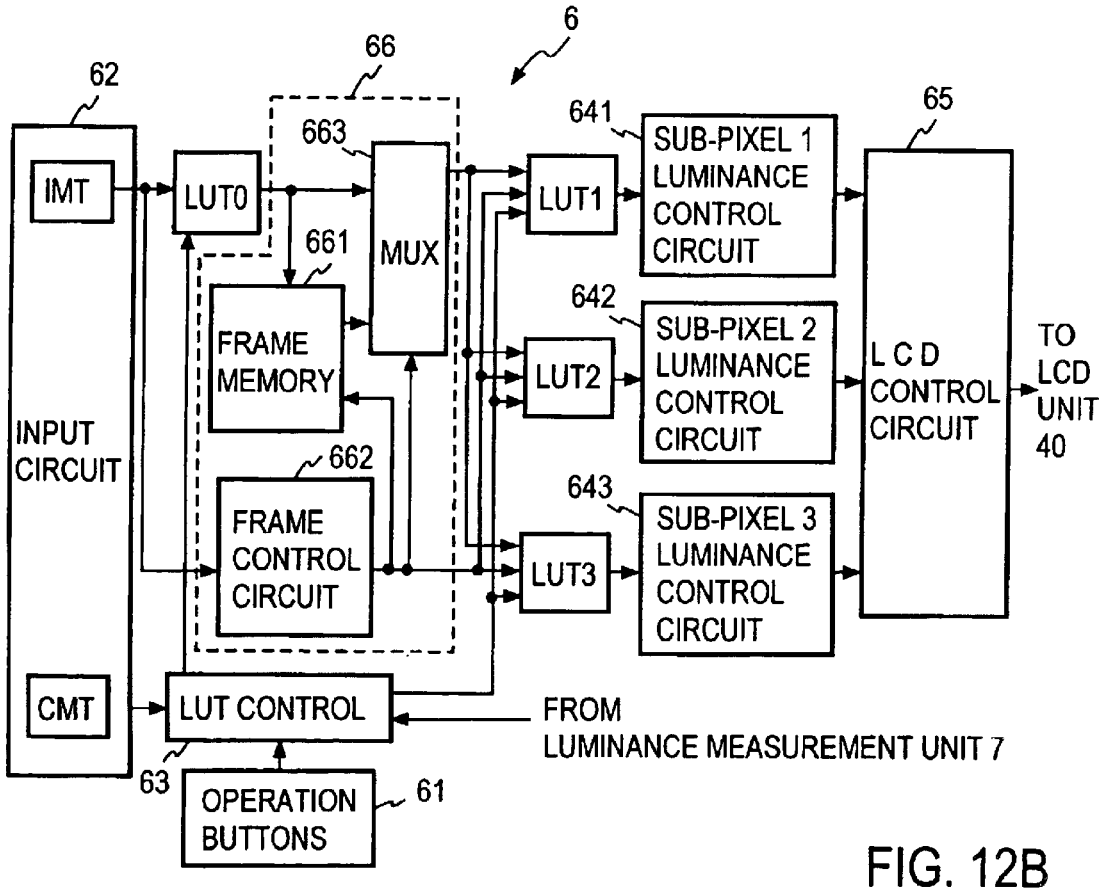
FIG. 12B is a block diagram showing one specified example of the control unit shown in FIG. 12A.

As shown in FIG. 12A, the twelfth embodiment of the liquid crystal display has the same diagrammatical construction as that of the eleventh embodiment discussed above. However, as shown in FIG. 12B, in the display of the twelfth embodiment, the control unit 6 further includes a time base control circuit 66 added thereto which comprises a frame memory 661, a frame control circuit 662 and a multiplexer (MUX) 663. The circuit construction of this control unit 6 is the same as that of the second embodiment, and portions and elements or components in FIG. 12B corresponding to those in FIG. 2B will be denoted by the same reference characters attached thereto, and the operations and explanation thereof will be omitted.

In the twelfth embodiment, too, in accordance with the control of the frame control circuit 662, the two luminance control signals each having 8 bits based on two video signals one being the first video signal of frame N and the other being the second video signal of frame N are supplied in regular sequence to the liquid crystal display unit 40 through the liquid crystal display control circuit 65, and so two video signals of the same Nth frame are displayed in regular sequence on the liquid crystal panel 4 of the liquid crystal display unit 40. Accordingly, if luminance of each of three sub-pixels 1, 2 and 3 constituting each pixel is controlled by a control signal of 8 bits over 256 stages of gradation, luminance control of 1021 stages of gradation as to the first video signal of frame N and luminance control of 1021 stages of gradation as to the second video signal of frame N can be done, and so the luminance control of 2042 stages of gradation in total (in reality, up to 2041 stages of gradation since two of the luminance value 0 are unified to one) can be done.

Explaining concretely, in the liquid crystal display of the twelfth embodiment, in case luminance of each of three sub-pixels 1, 2 and 3 constituting each pixel is electronically controlled by the control signal of 8 bits over 256 stages of gradation extending from 0 to 255 stages, assuming that regarding the first video signal of frame N, the luminance value of the sub-pixel 1 on which the ND filter 1F having its light transmittance of 100% is mounted is SB11, the luminance value of the sub-pixel 2 on which the ND filter 2F having its light transmittance of 50% is mounted is SB12, and the luminance value of the sub-pixel 3 on which the ND filter 2F having its light transmittance of 50% is mounted is SB13, and that regarding the second video signal of frame N, the luminance value of the sub-pixel 1 on which the ND filter 1F having its light transmittance of 100% is mounted is SB21, the luminance value of the sub-pixel 2 on which the ND filter 2F having its light transmittance of 50% is mounted is SB22, and the luminance value of the sub-pixel 3 on which the ND filter 2F having its light transmittance of 50% is mounted is SB23, then the summed luminance value Y of one pixel is obtained from the following equation (7).

$$Y=SB11+SB12+SB13+SB21+SB22+SB23 \quad (7)$$

The summed luminance value Y monotonically increases as shown in the following Table 12 with the luminance value 0.5 of the sub-pixel 3 as the least unit, and luminance values of 2041 stages can be obtained.

TABLE 12

| No. | SB11 | SB12 | SB13 | SB21 | SB22 | SB23 | Y |
|---|---|---|---|---|---|---|---|
| 1 | 0 | 0 | 0 | 0 | 0 | 0 | 0.0 |
| 2 | 0 | 0 | 0 | 0 | 0 | 1 | 0.5 |
| 3 | 0 | 0 | 1 | 0 | 0 | 1 | 1.0 |
| 4 | 0 | 0 | 1 | 0 | 1 | 1 | 1.5 |
| 5 | 0 | 0 | 1 | 1 | 0 | 1 | 2.0 |
| 6 | 0 | 1 | 1 | 1 | 0 | 1 | 2.5 |
| 7 | 0 | 1 | 1 | 1 | 1 | 1 | 3.0 |
| 8 | 0 | 1 | 1 | 1 | 1 | 2 | 3.5 |
| . | . | . | . | . | . | . | . |
| . | . | . | . | . | . | . | . |
| . | . | . | . | . | . | . | . |
| 2040 | 255 | 255 | 255 | 255 | 255 | 254 | 1019.5 |
| 2041 | 255 | 255 | 255 | 255 | 255 | 255 | 1020.0 |

Thus, there is provided a two-dimensional monochrome liquid crystal display having its luminance resolution of 2041 stages. As discussed above, the liquid crystal display of the twelfth embodiment has not only its luminance resolution of about twice that of the eleventh embodiment but also advantages that a moving picture can be reproduced, the liquid crystal display of the twelfth embodiment can easily be manufactured, and so on, as in the eleventh embodiment. Further, there are a plurality of ways to select the luminance values of 2041 stages, as in the eleventh embodiment.

In the eleventh and the twelfth embodiments, though an ND filter having light transmittance of 100% is mounted on one of the three sub-pixels, to mount the ND filter having light transmittance of 100% on one sub-pixel is equivalent to that no ND filter is mounted on one sub-pixel. Accordingly, the same result may be obtained even in case no ND filter is mounted on one sub-pixel, and an ND filter having light transmittance of 50% is mounted on the remaining two sub-pixels.

In addition, in the twelfth embodiment, in case a video signal sent from a computer or the like is a still picture or still image, it is unnecessary to output a picture or image of the same frame two times, and hence a transmitted picture or image may be inputted directly to the first, second and third look-up table circuits LUT1, LUT2 and LUT3 without storing it in the frame memory 661. In this case, it is arranged that luminance of each of three sub-pixels 1, 2 and 3 constituting each pixel of Nth frame and (N+1)th frame is controlled by a control signal of, for example, 8 bits to display luminance of each pixel by the summed luminance value of both Nth and (N+1)th frames. Consequently, the frame memory 661 and the multiplexer 663 may be omitted. Moreover, if the function of the frame control circuit 662 is transferred to the LUT control circuit 63, the frame control circuit 662 also may be omitted. In other words, in case a video signal sent from a computer or the like is a still picture or still image, it is possible to make the luminance resolution of the liquid crystal display of the twelfth embodiment high such as about twice that of the eleventh embodiment or so even if the time base control circuit 66 is not provided.

Next, the thirteenth embodiment of the two-dimensional monochrome bit face display according to the present invention will be described in detail with reference to FIG. 13.

Figure 13A:
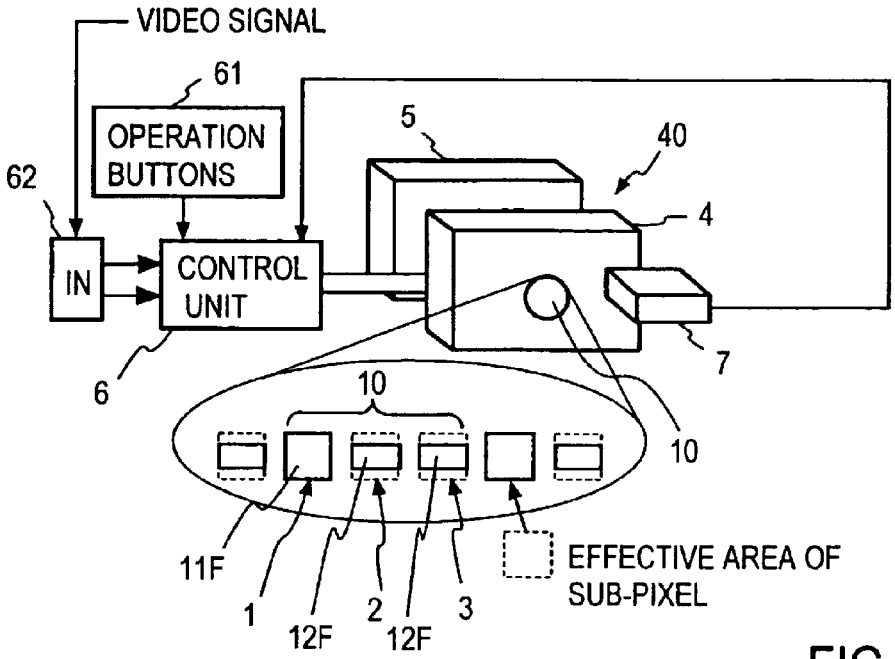
FIG. 13A is a diagrammatical view illustrating the thirteenth embodiment of the two-dimensional monochrome bit face display according to the present invention.
Figure 13B:
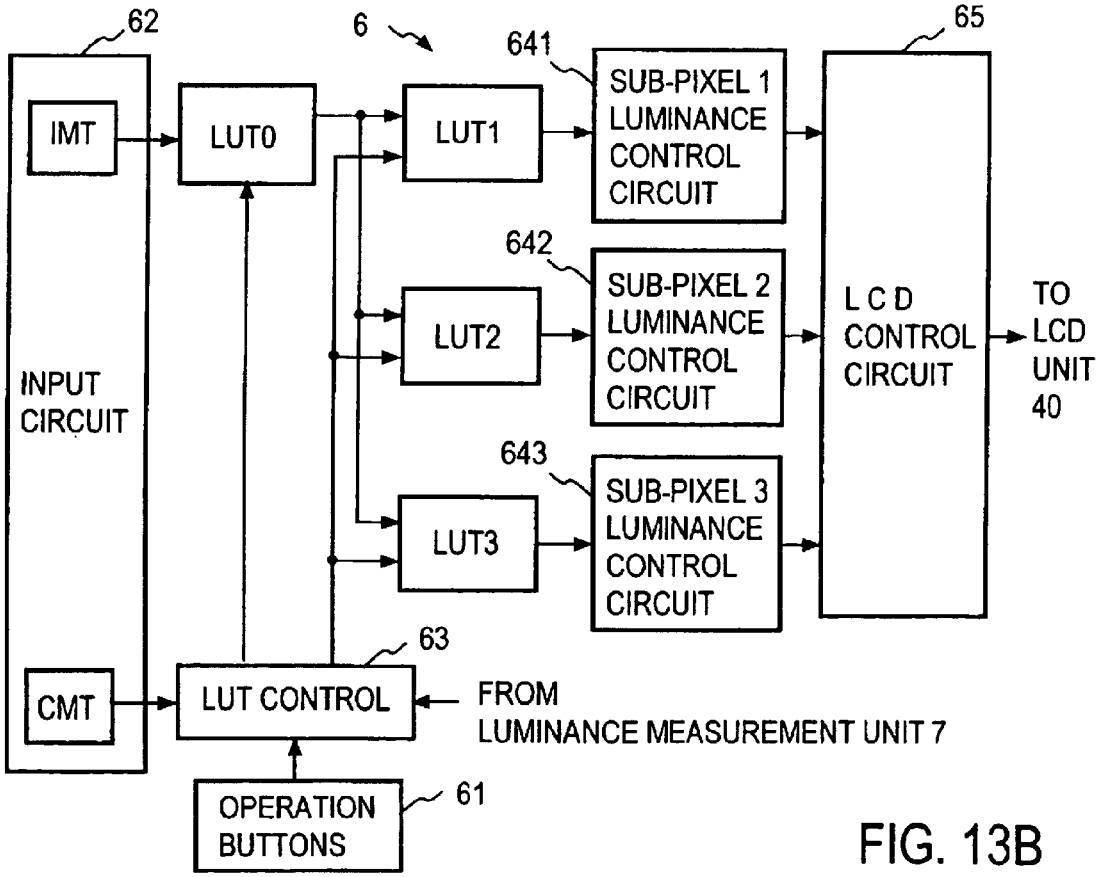
FIG. 13B is a block diagram showing one specified example of the control unit shown in FIG. 13A.

FIG. 13A is a diagrammatical view showing the thirteenth embodiment of the two-dimensional monochrome bit face display in which the present invention is applied to a liquid crystal display. As in the first embodiment, this display comprises: a liquid crystal display unit 40 including a liquid crystal display face (liquid crystal panel) 4 composed of a many number of pixels, and a backlight 5; a control unit 6 that controls luminance or intensity of each of the pixels of the liquid crystal panel 4; operation buttons 61 for inputting a various kinds of commands into the control unit 6; an input circuit (IN) 62 that receives a video or picture or image signal (hereinafter, referred to simply as video signal) and a control command transmitted from the outside; and a luminance measurement unit 7 that measures luminance or brightness of the top surface of the liquid crystal panel 4 and inputs the measured luminance into the control unit 6. FIG. 13B is a block diagram showing one specified example of the control unit 6 shown in FIG. 13A together with the operation buttons 61 and the input circuit 62.

The display of the thirteenth embodiment also adopts the space modulation dither method discussed above, and hence, as shown in explanatory diagram in FIG. 13A, one pixel 10 is constituted by three sub-pixels 1, 2 and 3. In this embodiment, on the three sub-pixels constituting each of the pixels of the liquid crystal panel 4 are mounted mask filters having windows or openings of different sizes for making effective areas of sub-pixels through which light passes different, respectively. Hereinafter, such filters will be referred to simply as mask filters. For example, as shown in FIG. 13A, on the sub-pixel 1 of each pixel is mounted a mask filter 11F for making light pass through all over the area of the sub-pixel 1, that is, for making light pass through 100% of the area of the sub-pixel 1, on the sub-pixel 2 of each pixel is mounted a mask filter 12F for making light pass through 50% of the area of the sub-pixel 2, and on the sub-pixel 3 of each pixel is also mounted a mask filter 12F for making light pass through 50% of the area of the sub-pixel 3. In other words, the mask filter 11F has its window the size of which is equal to the effective area of the sub-pixel 1, and the mask filter 12F has its window the size of which is equal to a half of the effective area of each of the sub-pixels 2 and 3.

A work or operation for mounting the above-mentioned mask filters on the sub-pixels of each of all pixels of the liquid crystal panel 4 respectively is easy because in a well known and conventionally used color liquid crystal display, instead of forming the R, G and B filters, the mask filters of 100%, 50% and 50% may be formed. Therefore, there occurs no problem in manufacture of the liquid crystal panel 4.

The control unit 6 has the same construction as that of the first embodiment discussed before as shown in FIG. 13B, and hence portions and elements or components in FIG. 13B corresponding to those in FIG. 1B will be denoted by the same reference characters attached thereto, and the operations and explanation thereof will be omitted.

In the liquid crystal display of the thirteenth embodiment, if respective luminances of the three sub-pixels 1, 2 and 3 constituting each pixel are electronically controlled over 256 stages of gradation extending from 0 to 255 stages in accordance with control signals each being of 8 bits, as in the eleventh embodiment, from the equation (6), the summed luminance value Y of one pixel monotonically increases as shown in the Table 10 already described with the luminance value 0. 5 of the sub-pixel 3 as the least unit, and luminance values of 1021 stages can be obtained. That is, the luminance resolution of one pixel becomes 1021 stages of gradation and hence it is possible to make the luminance resolution of the liquid crystal display high up to 1021 stages of gradation. In addition, since only the space modulation dither method is adopted, any problem of flicker does not occur and hence a moving picture can be reproduced. Furthermore, the liquid crystal display unit can be manufactured by substituting the mask filters for the R, G and B filters of the liquid crystal display unit in which each of the pixels is constituted by three sub-pixels developed in a color liquid crystal display as well as control circuits commonly used in a conventional color liquid crystal display can be utilized almost as they are as the control circuits for the liquid crystal display unit. Accordingly, there is also obtained an advantage that the liquid crystal display of the thirteenth embodiment can easily be manufactured.

Further, there are a plurality of ways to select the luminance values of 1021 stages as in the eleventh embodiment, and the way of increasing the luminance values as shown in the Table 11 already described may be taken.

Next, the fourteenth embodiment of the two-dimensional monochrome bit face display according to the present invention will be described in detail with reference to FIG. 14. This fourteenth embodiment is one in which the present invention is also applied to a liquid crystal display. However, the fourteenth embodiment is arranged such that the luminances of the three sub-pixels 1, 2 and 3 constituting one pixel in the thirteenth embodiment are very minutely shifted in the direction of time base to convert a picture or image of every other frame into a picture or image consisting of two frames and the luminance of one pixel is displayed by the summed luminance value obtained from addition of the luminance of a pixel of one of the two frames and the luminance of the corresponding pixel of the other of the two frames. This results in a further improvement in the luminance resolution of the liquid crystal display.

Figure 14A:
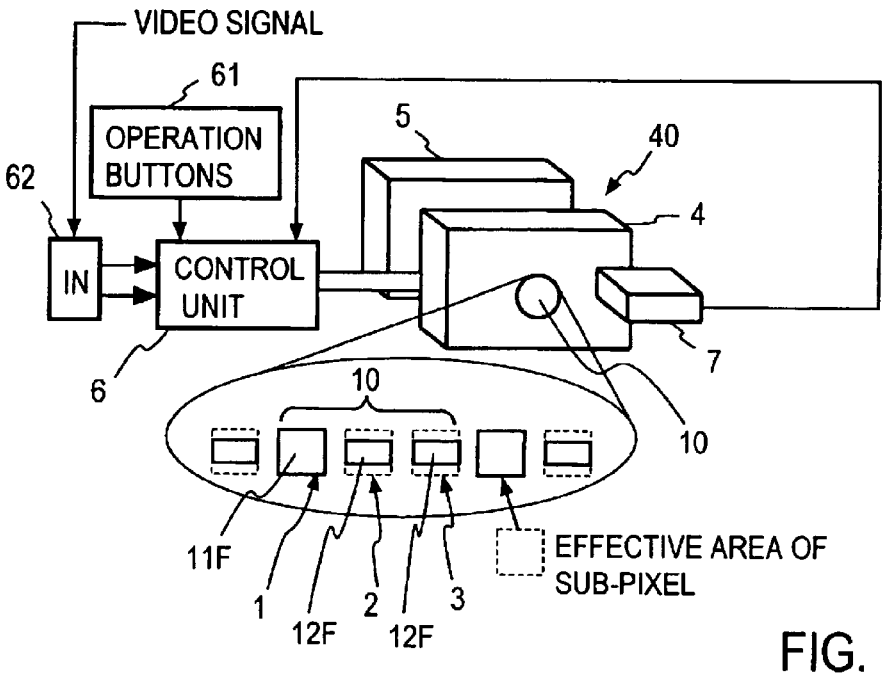
FIG. 14A is a diagrammatical view illustrating the fourteenth embodiment of the two-dimensional monochrome bit face display according to the present invention.
Figure 14B:
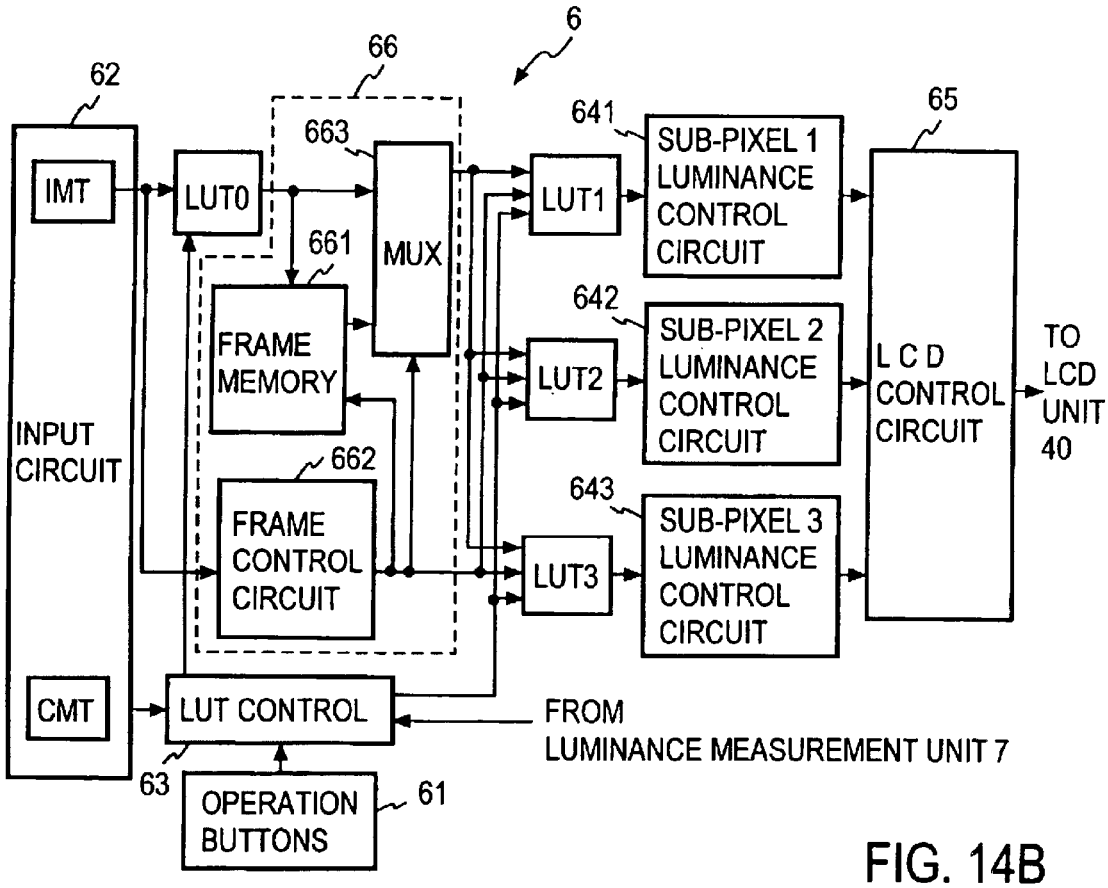
FIG. 14B is a block diagram showing one specified example of the control unit shown in FIG. 14A.

As shown in FIG. 14A, the fourteenth embodiment of the liquid crystal display has the same diagrammatical construction as that of the thirteenth embodiment discussed above. However, as shown in FIG. 14B, in the display of the fourteenth embodiment, the control unit 6 further includes a time base control circuit 66 added thereto which comprises a frame memory 661, a frame control circuit 662 and a multiplexer (MUX) 663. The circuit construction of this control unit 6 is the same as that of the second embodiment, and portions and elements or components in FIG. 14B corresponding to those in FIG. 2B will be denoted by the same reference characters attached thereto, and the operations and explanation thereof will be omitted.

In the fourteenth embodiment, too, in accordance with the control of the frame control circuit 662, the two luminance control signals each having 8 bits based on two video signals one being the first video signal of frame N and the other being the second video signal of frame N are supplied in regular sequence to the liquid crystal display unit 40 through the liquid crystal display control circuit 65, and so two video signals of the same Nth frame are displayed in regular sequence on the liquid crystal panel 4 of the liquid crystal display unit 40. Accordingly, if luminance of each of three sub-pixels 1, 2 and 3 constituting each pixel is electronically controlled by a control signal of 8 bits over 256 stages of gradation extending from 0 to 255 stages, luminance control of 1021 stages of gradation as to the first video signal of frame N and luminance control of 1021 stages of gradation as to the second video signal of frame N can be done, and so the luminance control of 2042 stages of gradation in total (in reality, up to 2041 stages of gradation since two of the luminance value 0 are unified to one) can be done. Thus, there is provided a two-dimensional monochrome liquid crystal display having its luminance resolution of 2041 stages.

Further, the summed luminance value Y of one pixel is obtained from the equation (7) described before. This summed luminance value Y monotonically increases as shown in the Table 12 already described with the luminance value 0.5 of the sub-pixel 3 as the least unit, and luminance values of 2041 stages can be obtained. In addition, there are a plurality of ways to select the luminance values of 2041 stages, as in the eleventh embodiment.

As discussed above, the liquid crystal display of the fourteenth embodiment has not only its luminance resolution of about twice that of the thirteenth embodiment but also advantages that a moving picture can be reproduced, the liquid crystal display of the fourteenth embodiment can easily be manufactured, and so on, as in the thirteenth embodiment.

In the thirteenth and the fourteenth embodiments, though on one of the three sub-pixels is mounted a mask filter for making light pass through 100% of the area of the one sub-pixel, to mount the mask filter having light transmittance of 100% on one sub-pixel is equivalent to that no mask filter is mounted on one sub-pixel. Accordingly, the same result may be obtained even in case no mask filter is mounted on one sub-pixel, and a mask filter having light transmittance of 50% is mounted on the remaining two sub-pixels.

In addition, in the fourteenth embodiment, in case a video signal sent from a computer or the like is a still picture or still image, it is unnecessary to output a picture or image of the same frame two times, and hence a transmitted picture or image may be inputted directly to the first, second and third look-up table circuits LUT1, LUT2 and LUT3 without storing it in the frame memory 661. In this case, it is arranged that luminance of each of three sub-pixels 1, 2 and 3 constituting each pixel of Nth frame and (N+1)th frame is controlled by a control signal of, for example, 8 bits to display luminance of each pixel by the summed luminance value of both Nth and (N+1)th frames. Consequently, the frame memory 661 and the multiplexer 663 may be omitted. Moreover, if the function of the frame control circuit 662 is transferred to the LUT control circuit 63, the frame control circuit 662 also may be omitted. In other words, in case a video signal sent from a computer or the like is a still picture or still image, it is possible to make the luminance resolution of the liquid crystal display of the fourteenth embodiment high such as about twice that of the thirteenth embodiment or so even if the time base control circuit 66 is not provided.

Next, the fifteenth embodiment of the two-dimensional monochrome bit face display according to the present invention will be described in detail with reference to FIG. 15.

Figure 15:
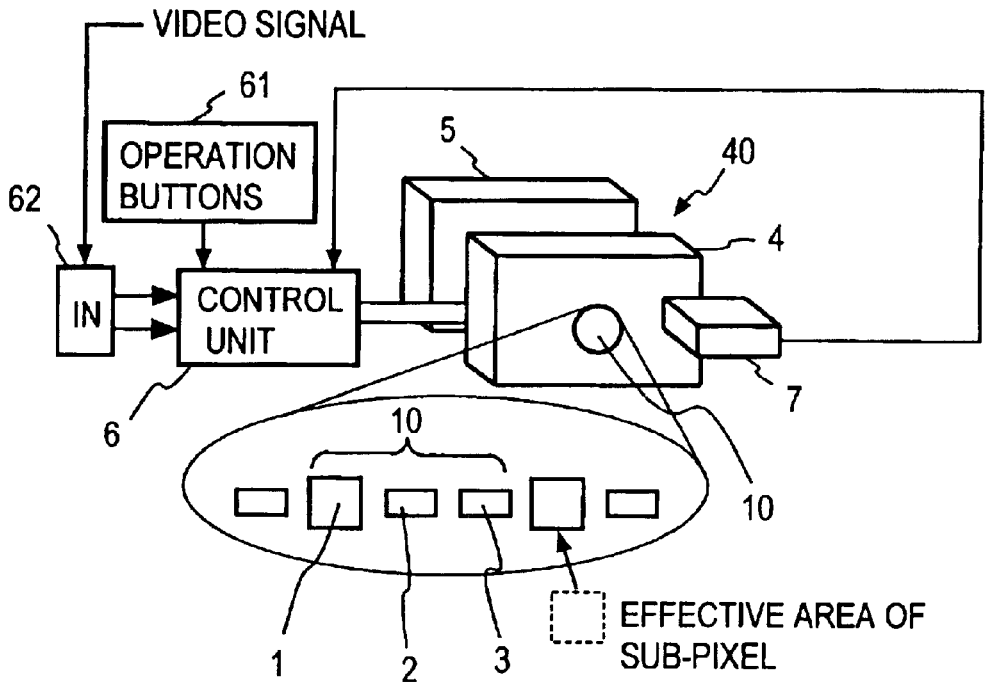
FIG. 15 is a diagrammatical view illustrating the fifteenth embodiment of the two-dimensional monochrome bit face display according to the present invention.

FIG. 15 is a diagrammatical view showing the fifteenth embodiment of the two-dimensional monochrome bit face display in which the present invention is applied to a liquid crystal display. As in the first embodiment, this display comprises: a liquid crystal display unit 40 including a liquid crystal display face (liquid crystal panel) 4 composed of a many number of pixels, and a backlight 5; a control unit 6 that controls luminance or intensity of each of the pixels of the liquid crystal panel 4; operation buttons 61 for inputting a various kinds of commands into the control unit 6; an input circuit (IN) 62 that receives a video or picture or image signal (hereinafter, referred to simply as video signal) and a control command transmitted from the outside; and a luminance measurement unit 7 that measures luminance or brightness of the top surface of the liquid crystal panel 4 and inputs the measured luminance into the control unit 6.

The display of this fifteenth embodiment also adopts the space modulation dither method discussed above, and hence, as shown in explanatory diagram in FIG. 15, one pixel 10 is constituted by three sub-pixels 1, 2 and 3. In this embodiment, it is arranged that effective areas of the three sub-pixels constituting each of the pixels of the liquid crystal panel 4 are made different so that the quantity of light (luminous energy) passing through each of the three sub-pixels differs.

For example, as shown in FIG. 15, the sub-pixel 1 of each pixel is manufactured to have the same area as that of an normal sub-pixel, and the sub-pixels 2 and 3 of each pixel are manufactured to have their areas equal to 50% of the area of the sub-pixel 1. By manufacturing the three sub-pixels 1, 2 and 3 to have their areas in the proportion of 1:0.5:0.5, if the quantity of light passing through the sub-pixel 1 is 100%, the quantity of light passing through the sub-pixel 2 becomes 50%, and the quantity of light passing through the sub-pixel 3 also becomes 50%.

The control unit 6 is not shown since a control unit having the same construction as that of the first embodiment discussed before may be used as the control unit 6. In addition, the control operations of the control unit 6 are the same as that of the first embodiment, and the explanation thereof will be omitted.

In the liquid crystal display of the fifteenth embodiment, if respective luminances of the three sub-pixels 1, 2 and 3 constituting each pixel are electronically controlled over 256 stages of gradation extending from 0 to 255 stages in accordance with control signals each being of 8 bits, as in the eleventh or the thirteenth embodiment, from the above equation (6), the luminance resolution of one pixel becomes 1021 stages of gradation as shown in the Table 10 already described, and hence it is possible to make the luminance resolution of the liquid crystal display high up to 1021 stages of gradation. In addition, since only the space modulation dither method is adopted, any problem of flicker does not occur and hence a moving picture can be reproduced. Furthermore, control circuits commonly used in a conventional color liquid crystal display can be utilized almost as they are as the control circuits for the liquid crystal display unit. Accordingly, there is also obtained an advantage that the liquid crystal display of the fifteenth embodiment can easily be manufactured.

In the liquid crystal display of the fifteenth embodiment, as in the second embodiment, it may be arranged that the luminances of the three sub-pixels 1, 2 and 3 constituting one pixel are very minutely shifted in the direction of time base to convert a picture or image of every other frame into a picture or image consisting of two frames, and the luminance of one pixel is displayed by the summed luminance value obtained from addition of the luminance of a pixel of one of the two frames and the luminance of the corresponding pixel of the other of the two frames. According to such arrangement, it is possible to make the luminance resolution of the liquid crystal display high up to 2041 stages of gradation as shown in the Table 12 already described. As the control unit 6, a control unit having the construction shown in FIG. 2B may be used. In addition, there are a plurality of ways to select the luminance values of 2041 stages, as in the eleventh embodiment.

In the eleventh, twelfth, thirteenth, fourteenth, and fifteenth embodiments discussed above, since the quantity of light passing through the three sub-pixels 1, 2 and 3 that constitute one pixel has been set to have the proportion of 100%:50%:50%, though the theoretical gradation thereof becomes 1021 stages of gradation or 2041 stages of gradation, the luminance is none the less lowered merely to 200/300% even if a backlight that is the same as prior art one is used. Accordingly, it is sufficient to carry out a correction of 300/200% as to the luminance, and hence there is obtained a further advantage that the life time of the backlight is prolonged.

Further, in each of the first through the fifth embodiments, the present invention has been applied to a liquid crystal display that is a typical example of the two-dimensional monochrome bit face display. It goes without saying that the present invention may be applied to a two-dimensional monochrome bit face display using PDP (plasma display panel), DMD (digital micromirror device) or the like and the same function and effects can be obtained.

In addition, it should be noted that though luminance of each sub-pixel has been controlled over 256 stages of gradation by a control signal of 8 bits, the control of luminance of each sub-pixel is not limited to 256 stages. If luminance of each sub-pixel is controlled by a control signal of 9 bits or 10 bits or more than 10 bits, luminance of each sub-pixel can be controlled over many stages of gradation larger than 256 stages of gradation, and the luminance resolution is further improved. Further, it is to be noted that the operation and function of the fourth look-up table circuit LUT0 can be also performed in the first, second and third look-up table circuits LUT1, LUT2 and LUT3, and so, the fourth look-up table circuit LUT0 may be omitted.

As will be apparent from the foregoing description, according to the present invention, with simple construction or configuration, the luminance resolution of a two-dimensional monochrome bit face display such as a liquid crystal display can be made high up to a value equal to or higher than that of a CRT monitor. Accordingly, the two-dimensional monochrome bit face display can be conveniently used as a monochrome picture or image display for various kinds of medical electronic appliances, instruments, and the like. Moreover, if the two-dimensional monochrome bit face display according to the present invention having high luminance and high resolution as well as of small size and light weight is used, in place of a CRT monitor, as a display (monitor) of PACS (picture archiving and communication system) on which great importance is placed hereafter in the industry of medical appliances and instruments, there are obtained advantages that it is easy to handle the display and a space for true medical treatment use can be enlarged. In addition, since only the space modulation dither method is adopted, any problem of flicker does not occur and hence a moving picture can be reproduced.

While the present invention has been described with regard to the preferred embodiments shown by way of example, it will be apparent to those skilled in the art that various modifications, alterations, changes, and/or minor improvements of the embodiments described above can be made without departing from the spirit and the scope of the present invention. Accordingly, it should be understood that the present invention is not limited to the illustrated embodiments, and is intended to encompass all such modifications, alterations, changes, and/or minor improvements falling within the scope of the invention defined by the appended claims.

What is claimed is:

1. A two-dimensional monochrome bit face display having a bit face in which each pixel is constituted by three sub-pixels, the display comprising:

a neutral density filter having a light transmittance substantially equal to 50% that is mounted on one or two sub-pixels of the three sub-pixels constituting each of a plurality of respective pixels;

an input circuit that receives an image signal and a control command;

m sub-pixel luminance control circuits that output luminance control signals for controlling luminances of the m sub-pixels constituting the plurality of respective pixels;

m rewritable look-up table circuits each coupled to an input of a respective sub-pixel luminance control circuit to supply predetermined luminance information to the respective sub-pixel luminance control circuit;

a look-up table control circuit that controls content of look-up tables written into the m look-up table circuits; and a control circuit that controls luminance of the bit face on the basis of luminance control signals outputted by the m sub-pixel luminance control circuits.

2. The two-dimensional monochrome bit face display as set forth in claim 1, wherein the bit face display is a liquid crystal display.

3. The two-dimensional monochrome bit face display as set forth in claim 1 comprising a time base control circuit that varies the luminance of sub-pixels between two frames of an image on said display to present the image with an apparent luminance resolution that is greater than the luminance resolution of either frame of the image.

4. The two-dimensional monochrome bit face display as set forth in claim 3, wherein the bit face display is a liquid crystal display.

5. A two-dimensional monochrome bit face display having a bit face in which each pixel is constituted by three sub-pixels, the display comprising:

a mask filter having a window with light transmittance substantially equal to 50% that is mounted on one or two of the three sub-pixels constituting each of a plurality of respective pixels;

an input circuit that receives an image signal and a control command;

m sub-pixel luminance control circuits that output luminance control signals for controlling luminances of the m sub-pixels constituting the plurality of respective pixels;

m rewritable look-up table circuits each coupled to an input of a respective sub-pixel luminance control circuit to supply predetermined luminance information to the respective sub-pixel luminance control circuit;

a look-up table control circuit that controls content of look-up tables written into the m look-up table circuits; and a control circuit that controls luminance of the bit face on the basis of luminance control signals outputted by the m sub-pixel luminance control circuits.

6. The two-dimensional monochrome bit face display as set forth in claim 5, wherein the bit face display is a liquid crystal display.

7. The two-dimensional monochrome bit face display as set forth in claim 5, comprising a time base control circuit that varies the luminance of sub-pixels between two frames of an image on said display to present the image with an apparent luminance resolution that is greater than the luminance resolution of either frame of the image.

8. The two-dimensional monochrome bit face display as set forth in claim 7, wherein the bit face display is a liquid crystal display.

9. A two-dimensional monochrome bit face display having a bit face in which each pixel is constituted by m sub-pixels, where m is an integer equal to or greater than 3, the display comprising:

two or more filters that are mounted on at least some of the m sub-pixels constituting each of a plurality of respective pixels, wherein the filters are neutral density filters having relative light transmittances proportional to values substantially equal to $(½)^n$ where n is an integer;

an input circuit that receives an image signal and a control command;

m sub-pixel luminance control circuits that output luminance control signals for controlling luminances of the m sub-pixels constituting the plurality of respective pixels;

m rewritable look-up table circuits each coupled to an input of a respective sub-pixel luminance control circuit to supply predetermined luminance information to the respective sub-pixel luminance control circuit;

a look-up control circuit that controls content of look-up tables written into the m look-up table circuits; and a control circuit that controls luminance of the bit face on the basis of luminance control signals outputted by the m sub-pixel luminance control circuits.

10. The two-dimensional monochrome bit face display as set forth in claim 9 wherein m neutral density filters are mounted on the m sub-pixels of a respective pixel and n is an integer from 0 to m−1.

11. The two-dimensional monochrome bit face display as set forth in claim 10, wherein the bit face display is a liquid crystal display and m=3.

12. The two-dimensional monochrome bit face display as set forth in claim 10 comprising a time base control circuit that varies the luminance of sub-pixels between two frames of an image on said display to present the image with an apparent luminance resolution that is greater than the luminance resolution of either frame of the image.

13. The two-dimensional monochrome bit face display as set forth in claim 12, wherein the bit face display is a liquid crystal display and m=3.

14. The two-dimensional monochrome bit face display as set forth in claim 9 wherein (m−1) neutral density filters are mounted on (m−1) sub-pixels of the m sub-pixels of a respective pixel and n is an integer from 1 to m−1.

15. The two-dimensional monochrome bit face display as set forth in claim 14, wherein the bit face display is a liquid crystal display and m=3.

16. The two-dimensional monochrome bit face display as set forth in claim 14 comprising a time base control circuit that varies the luminance of sub-pixels between two frames of an image on said display to present the image with an apparent luminance resolution that is greater than the luminance resolution of either frame of the image.

17. The two-dimensional monochrome bit face display as set forth in claim 16, wherein the bit face display is a liquid crystal display and m=3.

18. The two-dimensional monochrome bit face display as set forth in claim 9 wherein each pixel is constituted by three sub-pixels and three neutral density filters are mounted on the three sub-pixels of a respective pixel having light transmittances proportional to values substantially equal to 100%, 100% and 50%.

19. The two-dimensional monochrome bit face display as set forth in claim 18, wherein the bit face display is a liquid crystal display.

20. The two-dimensional monochrome bit face display as set forth in claim 18 comprising a time base control circuit that varies the luminance of sub-pixels between two frames of an image on said display to present the image with an apparent luminance resolution that is greater than the luminance resolution of either frame of the image.

21. The two-dimensional monochrome bit face display as set forth in claim 20, wherein the bit face display is a liquid crystal display.

22. A two-dimensional monochrome bit face display as having a bit face in which each pixel is constituted by m sub-pixels, where m is an integer equal to or greater than 3, the display comprising:

two or more filters that are mounted on at least some of the m sub-pixels constituting each of a plurality of respective pixels, wherein the filters are mask filters having windows with relative light transmittances proportional to values substantially equal to $(½)^n$ where n is an integer;

an input circuit that receives an image signal and a control command;

m sub-pixel luminance control circuits that output luminance control signals for controlling luminances of the m sub-pixels constituting the plurality of respective pixels;

m rewritable look-up table circuits each coupled to an input of a respective sub-pixel luminance control circuit to supply predetermined luminance information to the respective sub-pixel luminance control circuit;

a look-up table control circuit that controls content of look-up tables written into the m look-up table circuits; and a control circuit that controls luminance of the bit face on the basis of luminance control signals outputted by the m sub-pixel luminance control circuits.

23. The two-dimensional monochrome bit face display as set forth in claim 22 wherein m mask filters are mounted on the m sub-pixels of a respective pixel and n is an integer from 0 to m−1.

24. The two-dimensional monochrome bit face display as set forth in claim 23, wherein the bit face display is a liquid crystal display and m=3.

25. The two-dimensional monochrome bit face display as set forth in claim 23 comprising a time base control circuit that varies the luminance of sub-pixels between two frames of an image on said display to present the image with an apparent luminance resolution that is greater than the luminance resolution of either frame of the image.

26. The two-dimensional monochrome bit face display as set forth in claim 25, wherein the bit face display is a liquid crystal display and m=3.

27. The two-dimensional monochrome bit face display as set forth in claim 22 wherein (m−1) mask filters are mounted on (m−1) sub-pixels of the m sub-pixel of a respective pixel and n is an integer from 1 to m−1.

28. The two-dimensional monochrome bit face display as set forth in claim 27, wherein the bit face display is a liquid crystal display and m=3.

29. The two-dimensional monochrome bit face display as set forth in claim 27 comprising a time base control circuit that varies the luminance of sub-pixels between two frames of an image on said display to present the image with an apparent luminance resolution that is greater than the luminance resolution of either frame of the image.

30. The two-dimensional monochrome bit face display as set forth in claim 29, wherein the bit face display is a liquid crystal display and n=3.

31. The two-dimensional monochrome bit face display as set forth in claim 22 wherein each pixel is constituted by three sub-pixels and three mask filters are mounted on the three sub-pixels of a respective pixel having light transmittances proportional to values substantially equal to 100%, 100% and 50%.

32. The two-dimensional monochrome bit face display as set forth in claim 31, wherein the bit face display is a liquid crystal display.

33. The two-dimensional monochrome bit face display as set forth in claim 31 comprising a time base control circuit that varies the luminance of sub-pixels between two frames of an image on said display to present the image with an apparent luminance resolution that is greater than the luminance resolution of either frame of the image.

34. The two-dimensional monochrome bit face display as set forth in claim 33, wherein the bit face display is a liquid crystal display.

* * * * *